US010947917B2

(12) United States Patent
Ottikkutti et al.

(10) Patent No.: US 10,947,917 B2
(45) Date of Patent: Mar. 16, 2021

(54) METHODS AND SYSTEM FOR SKIP-FIRING OF AN ENGINE

(71) Applicant: Transportation IP Holdings, LLC, Norwalk, CT (US)

(72) Inventors: Pradheepram Ottikkutti, Lawrence, PA (US); Alok Kumar, Bangalore (IN); Michael Majewski, Erie, PA (US); Seung-hyuck Hong, Niskayuna, NY (US); Kevin Scott McElhaney, Erie, PA (US); Roy James Primus, Niskayuna, NY (US); Omowoleola Akinyemi, Niskayuna, NY (US); Thomas Michael Lavertu, Niskayuna, NY (US); Santosh Meghani, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/486,124

(22) PCT Filed: Feb. 16, 2018

(86) PCT No.: PCT/US2018/018463

§ 371 (c)(1),
(2) Date: Aug. 14, 2019

(87) PCT Pub. No.: WO2018/152384

PCT Pub. Date: Aug. 23, 2018

(65) Prior Publication Data

US 2020/0232403 A1 Jul. 23, 2020

Related U.S. Application Data

(60) Provisional application No. 62/459,799, filed on Feb. 16, 2017.

(51) Int. Cl.
*F02D 41/00* (2006.01)
*F02D 17/02* (2006.01)
(Continued)

(52) U.S. Cl.
CPC ..... *F02D 41/0087* (2013.01); *F02D 17/02* (2013.01); *F02D 41/1497* (2013.01);
(Continued)

(58) Field of Classification Search
CPC .. F02D 41/0087; F02D 17/02; F02D 41/1497; F02D 41/3011; F02D 2200/0602;
(Continued)

(56) References Cited

U.S. PATENT DOCUMENTS 4,188,925 A * 2/1980 Jordan ..... F01L 9/02 123/90.12
5,826,563 A * 10/1998 Patel ..... F02D 17/02 123/481

(Continued)

FOREIGN PATENT DOCUMENTS

JP 02259279 A * 10/1990

OTHER PUBLICATIONS

ISA Korean Intellectual Property Office, International Search Report Issued in Application No. PCT/US2018/018463, dated May 18, 2018, WIPO, 4 pages.

*Primary Examiner* — Jacob M Amick
*Assistant Examiner* — Charles Brauch
(74) *Attorney, Agent, or Firm* — McCoy Russell LLP

(57) ABSTRACT

Various methods and systems are provided for skip-firing an engine. As one embodiment, a method for an engine includes firing all cylinders of the engine and not altering the closing timing of the intake valves when fueling demands are greater than a threshold. The method further includes skip-firing the engine when fueling demands are less than a threshold, and holding open the intake valves of skipped cylinders for a greater duration than intake valves of firing cylinders.

17 Claims, 8 Drawing Sheets

(51) Int. Cl.
*F02D 41/14* (2006.01)
*F02D 41/30* (2006.01)
*F02D 13/02* (2006.01)

(52) U.S. Cl.
CPC ..... *F02D 41/3011* (2013.01); *F02D 13/0203* (2013.01); *F02D 2041/001* (2013.01); *F02D 2200/0602* (2013.01); *F02D 2200/0802* (2013.01); *F02D 2200/0814* (2013.01)

(58) Field of Classification Search
CPC ..... F02D 2200/0814; F02D 2200/0802; F02D 13/0203; F02D 2041/001
See application file for complete search history.

(56) References Cited

U.S. PATENT DOCUMENTS

| | | | | |
|---|---|---|---|---|
| 6,647,947 | B2 * | 11/2003 | Boyer | F01L 1/34 123/198 F |
| 9,399,964 | B2 | 7/2016 | Younkins et al. | |
| 2010/0122688 | A1 * | 5/2010 | Sihler | F02D 41/1497 123/350 |
| 2011/0090938 | A1 * | 4/2011 | Akins | G01K 7/24 374/185 |
| 2011/0239984 | A1 * | 10/2011 | Lee | F02D 41/1498 123/339.14 |
| 2011/0253113 | A1 | 10/2011 | Roth et al. | |
| 2012/0035833 | A1 * | 2/2012 | Melis | F02D 41/401 701/104 |
| 2013/0305709 | A1 * | 11/2013 | Rollinger | F02M 26/05 60/601 |
| 2015/0322869 | A1 | 11/2015 | Shost et al. | |

* cited by examiner

METHODS AND SYSTEM FOR SKIP-FIRING OF AN ENGINE

CROSS-REFERENCE TO RELATED APPLICATIONS

The present application is a U.S. national phase of International Application No. PCT/US2018/018463 titled "METHODS AND SYSTEM FOR SKIP-FIRING OF AN ENGINE", and filed on Feb. 16, 2018. International Application No. PCT/US2018/018463 claims priority to U.S. Provisional Patent Application No. 62/459,799, titled "METHODS AND SYSTEM FOR SKIP-FIRING OF AN ENGINE," and filed on Feb. 16, 2017. The entire contents of each of the above-identified applications are hereby incorporated by reference for all purposes.

BACKGROUND

Technical Field

Embodiments of the subject matter disclosed herein relate to skip-firing cylinders of an internal combustion engine, and reducing pumping losses from skipped cylinders.

Discussion of Art

Smoke and emissions may be reduced during engine idling by skip-firing one or more engine cylinders. Skip-firing involves stopping fuel injection to some of the cylinders so that combustion does not occur in those cylinders. An engine cylinder may be "skipped" for a given engine cycle by not injecting fuel into the cylinder during that engine cycle. Hence, when skip-firing, only some of the cylinders undergo a normal combustion cycle, while the remaining "skipped" cylinders continue to reciprocate, but without any fuel. However, because valve actuation is driven mechanically by the crankshaft, valve timing remains the same regardless of whether or not a cylinder undergoes combustion. Thus, the intake valve of a skipped cylinder remains closed during most of the compression stroke and all of the power stroke, just as it would have if fuel had been injected. With the intake valve closed during the compression stroke, the piston must work to compress the air in the cylinder, resulting in increased pumping losses and reduced engine efficiency.

Further, even when the engine is not idling, such as during a low torque output condition, the fueling demands can drop sufficiently low such that each fuel injector injects the desired amount of fuel before fully opening. At such minimal fuel injection volumes, the injectors may be more inaccurate, leading to larger relative fuel metering errors and percentage variance in injection amounts from injection to injection, and injector to injector. As a result of the injection variability at low fueling levels, regulated emissions may increase. In addition, at low fueling levels the engine speed may fluctuate beyond the specified or acceptable range which could result in unstable engine operation. However, modern day engines mitigate unstable operation at low fueling through engine speed control strategies built into the engine controller. Yet, the capability of the engine controller may be limited. For example, typical engine controllers may be incapable of compensating for or mitigating large fluctuations in fueling quantity.

BRIEF DESCRIPTION

In one embodiment, a method for an engine (e.g., a method for controlling an engine system) includes skip-firing the engine when fueling demands are less than a threshold; and holding open intake valves of skipped cylinders for a greater duration than intake valves of firing cylinders.

DETAILED DESCRIPTION

Figure 1:
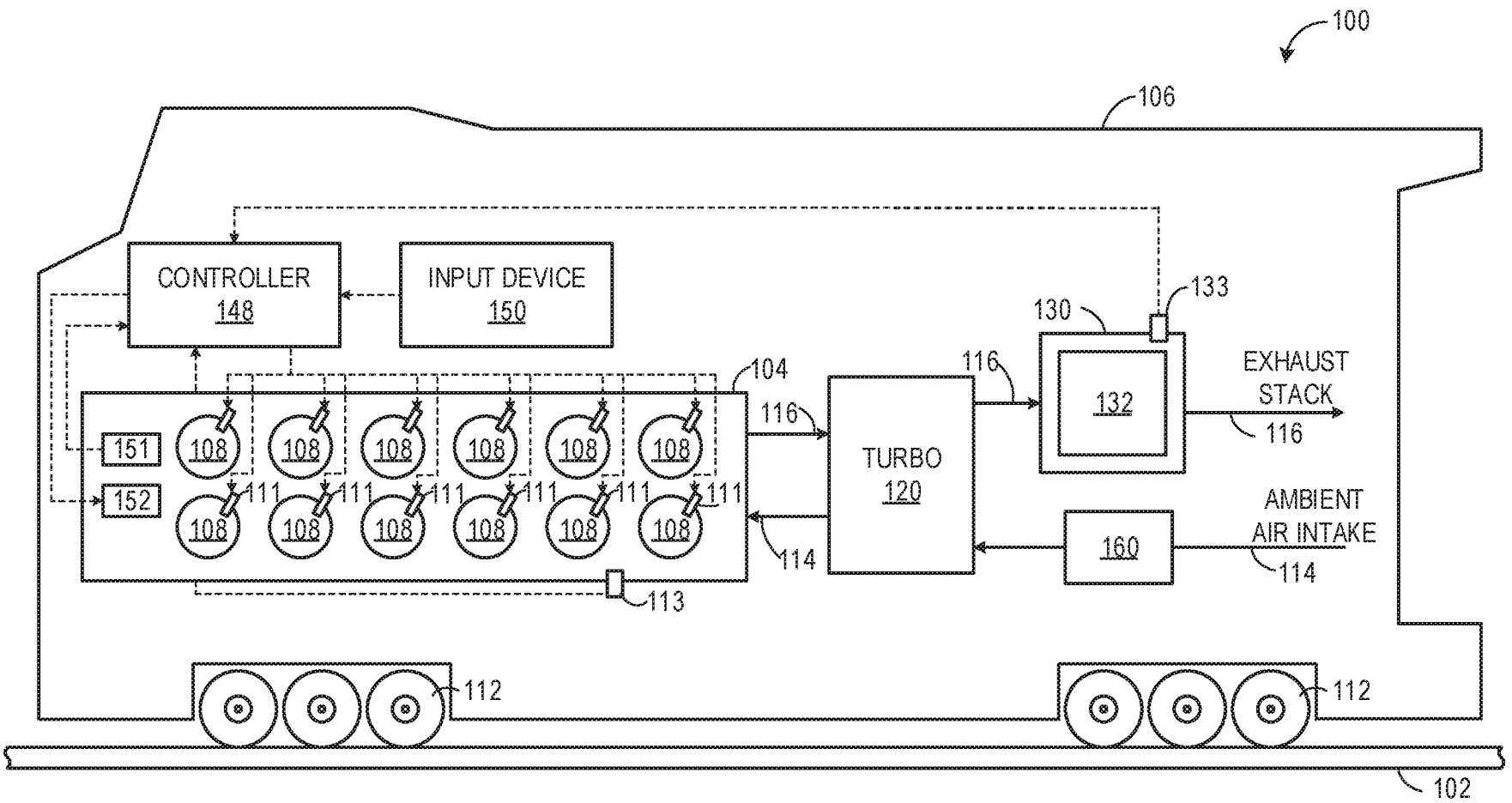
FIG. 1 shows a schematic diagram of a vehicle with an engine, according to an embodiment of the invention.

The following description relates to embodiments of skip-firing an engine based on fueling demands and/or engine speed, and adjusting a timing of intake valve closure for skipped cylinders. As one embodiment, a method for an engine may include skip-firing the engine when fueling demands are less than a threshold; and holding open intake valves of skipped cylinders for a greater duration than intake valves of firing cylinders. The engine may include a plurality of cylinders, each cylinder including a fuel injector and at least one intake valve and one exhaust valve. Actuation (e.g., opening and closing) of the intake and exhaust valves may be driven by rotation of a crankshaft via a cam system, such as camshaft and associated cam lobes. A controller of the engine may receive a signal from an input device, such as a hand lever, for a desired engine speed. The controller may responsively determine an amount of fuel to be injected by the fuel injectors to deliver the desired engine speed.

When the engine speed and load drops sufficiently low, such as during deceleration and/or engine idle, the commanded amount of fuel to be injected by the fuel injectors may drop to a point where the injector needle no longer reaches maximum lift. This region of operation is called the ballistic region of the injectors and is a mode of operation where the relative accuracy of the fuel injectors is reduced. Responsively, the controller may skip-fire the engine by commanding some of the fuel injectors to not inject fuel during an engine cycle to distribute the torque output demands amongst fewer "firing" cylinders, thus raising the amount of fuel to be injected by each active injector. In one example, the controller may determine when to initiate skip-fire based on fueling demands. In another example, the controller may additionally or alternatively determine when to initiate skip-fire based on engine speed. In yet another example, the controller may additionally or alternatively determine when to initiate skip-fire based on driver demanded torque. In still a further example, the controller may additionally or alternatively determine when to initiate skip-fire based on fuel rail pressure and/or the pulse-width (e.g., the magnitude of the pulse-width) of the pulse width modulated (PWM) injector (i.e. the PWM of the electromagnetic actuator used to control the injector needle and thus the fuel injection event).

The controller may further monitor torque imbalances amongst the cylinders and may use the measured torque imbalances to infer fuel metering errors (caused by fuel injector or injectors operating in the ballistic region) which may then determine when to initiate skip-fire. For example, if the cylinder-to-cylinder torque output variance is relatively high, fuel injection variance, and therefore fuel injector error may be relatively high as well, and the controller may switch to skip-firing the engine. Thus, the controller may adjust when skip-fire is initiated based on measured torque imbalances.

Further, while skip-firing the engine, the intake valves of firing cylinders may continue to be actuated via the cam system. However, the controller may vary the closing timing of the intake valves of non-firing cylinders via a second set of actuators that are not driven by the crankshaft. In particular, the second set of actuators may be electromagnetic actuators that open and close the intake valves in response to signals received from the controller, independently of the crankshaft driven cam system. The controller may hold open the intake valve or valves of non-firing cylinders during the compression stroke and at least a portion or all of the power stroke.

Figure 2A:
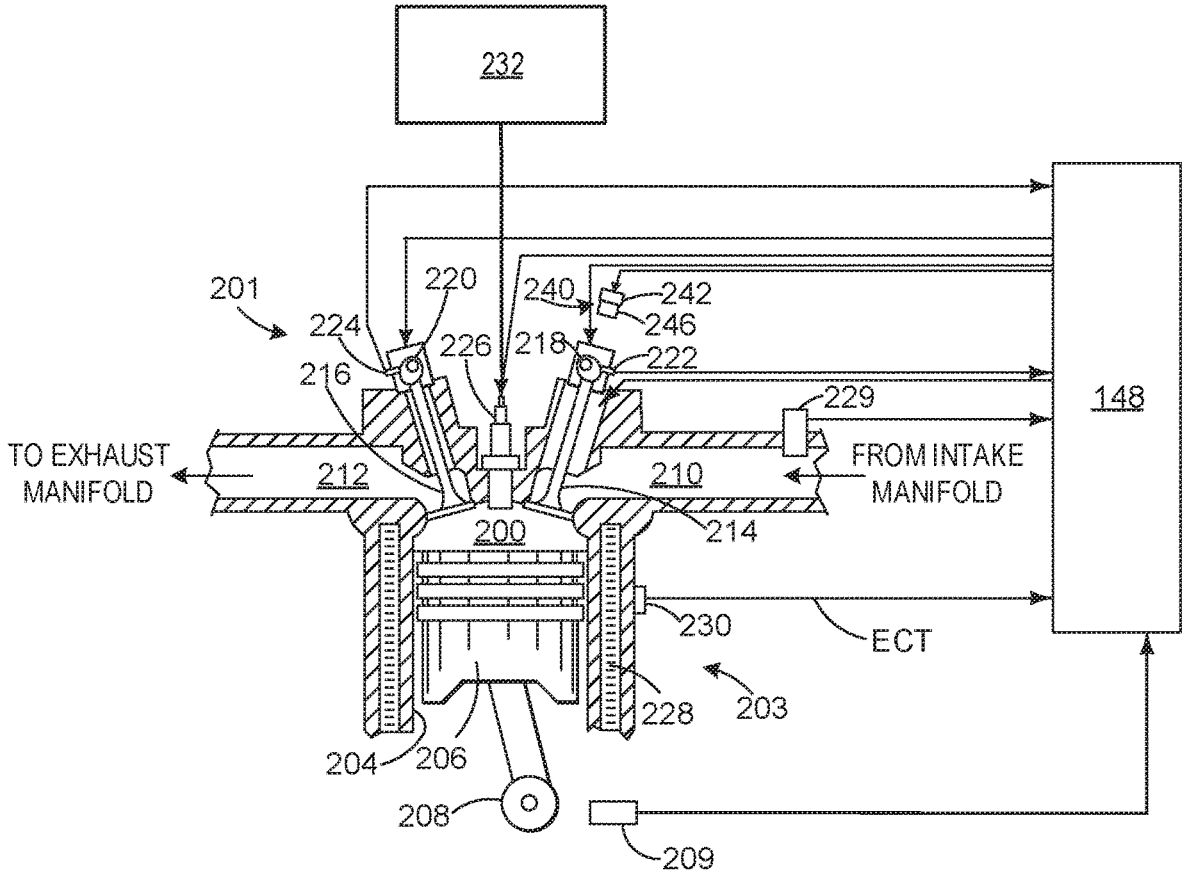
FIG. 2A shows a schematic diagram of a cylinder of the engine of FIG. 1, according to an embodiment of the invention.
Figure 2B:
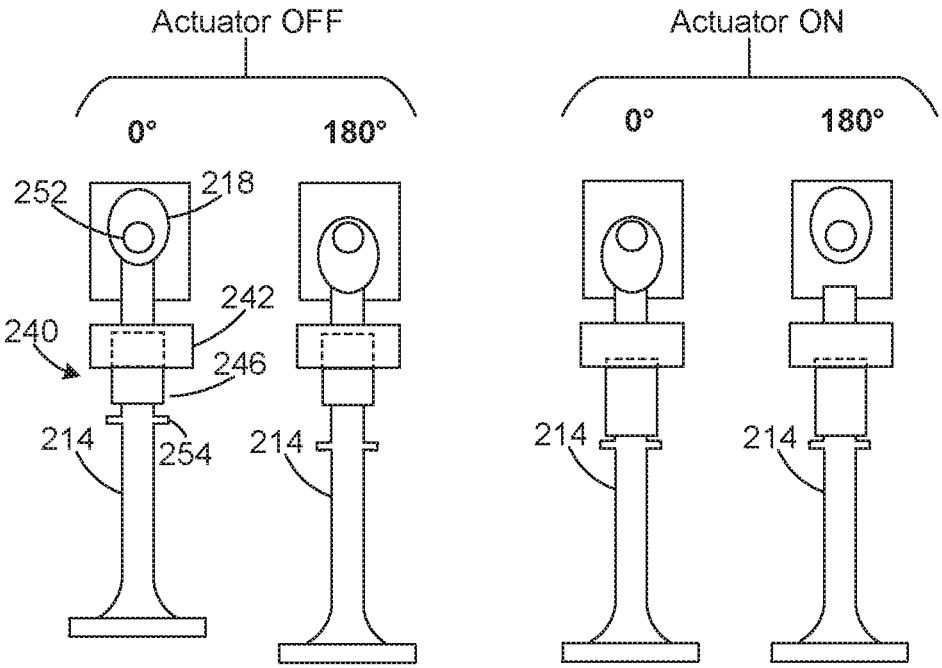
FIG. 2B shows a schematic diagram of an intake valve of the cylinder of FIG. 2A and a first configuration for an intake valve actuator, according to an embodiment of the invention.
Figure 2C:
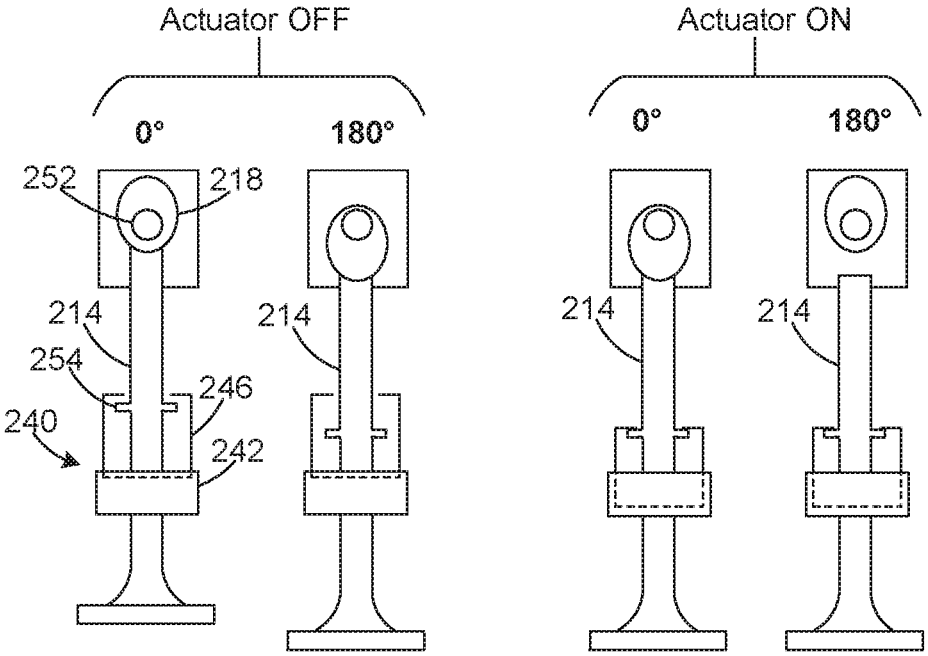
FIG. 2C shows a schematic diagram of an intake valve of the cylinder of FIG. 2A and a second configuration for the intake valve actuator of FIG. 2B, according to an embodiment of the invention.
Figure 3:
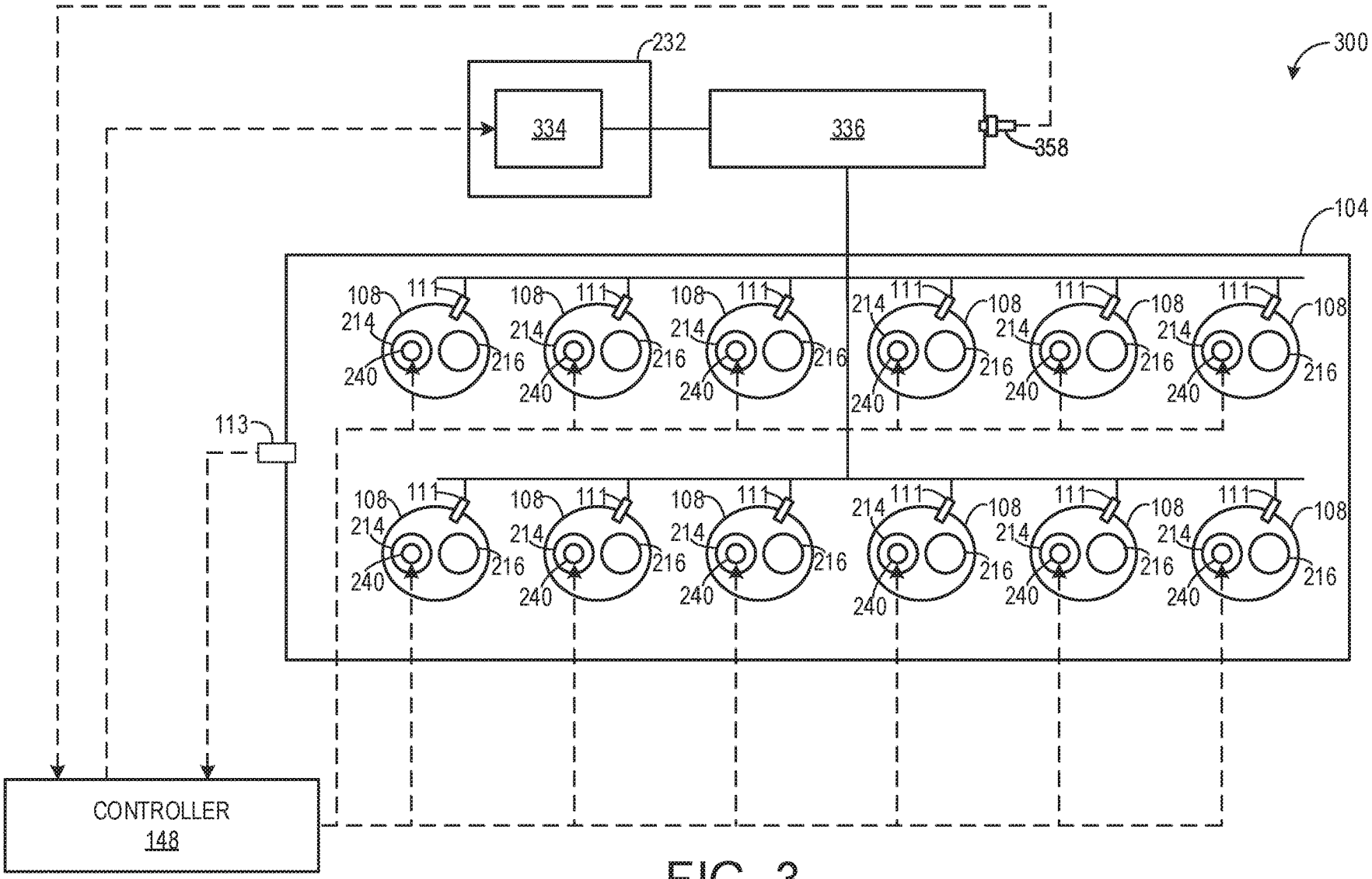
FIG. 3 shows a schematic diagram of the engine of FIG. 1, including the intake valve actuator of FIGS. 2B and 2C, according to an embodiment of the invention.
Figure 4:
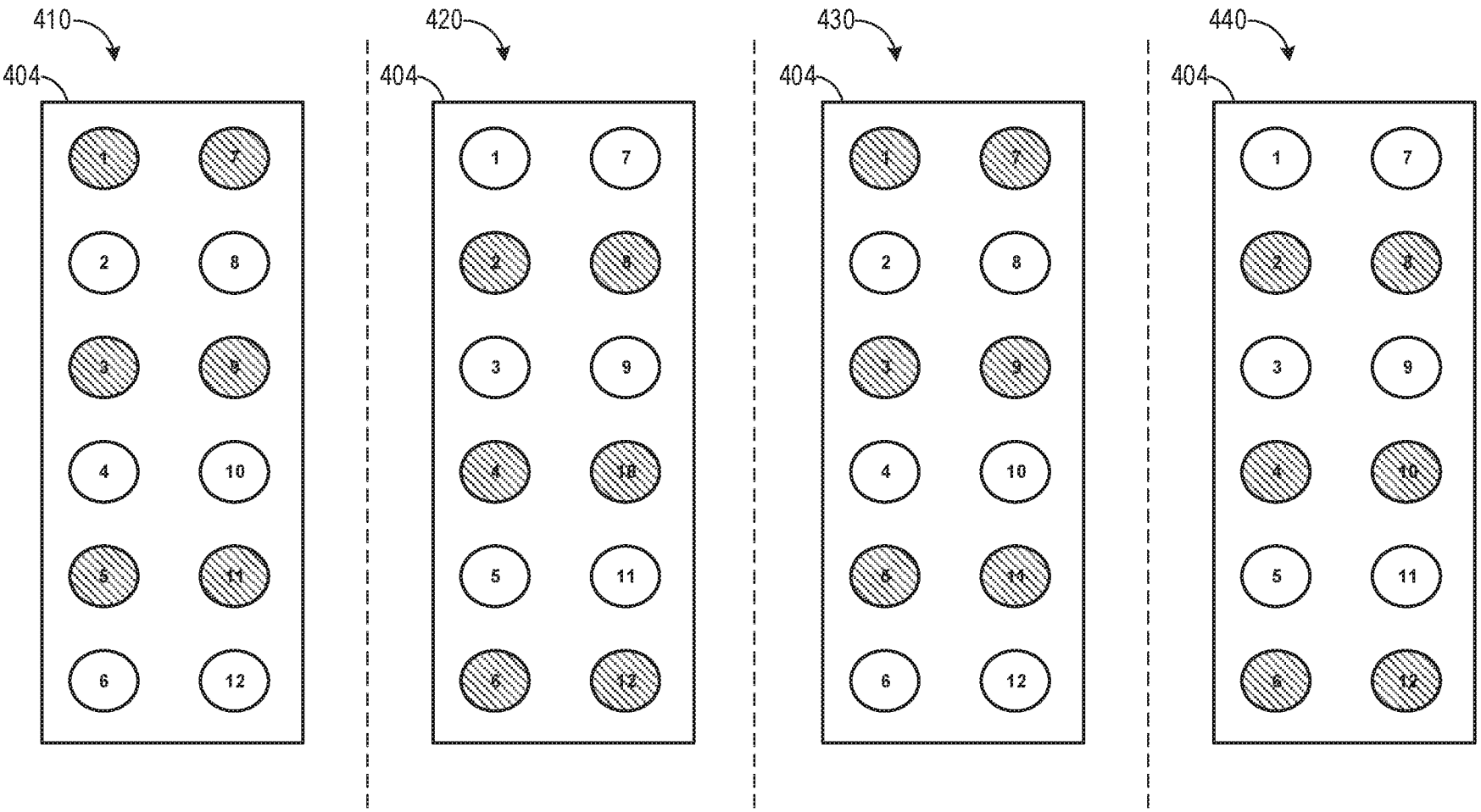
FIG. 4 shows a schematic diagram of an example skip-firing pattern for an engine, according to an embodiment of the invention.
Figure 5:
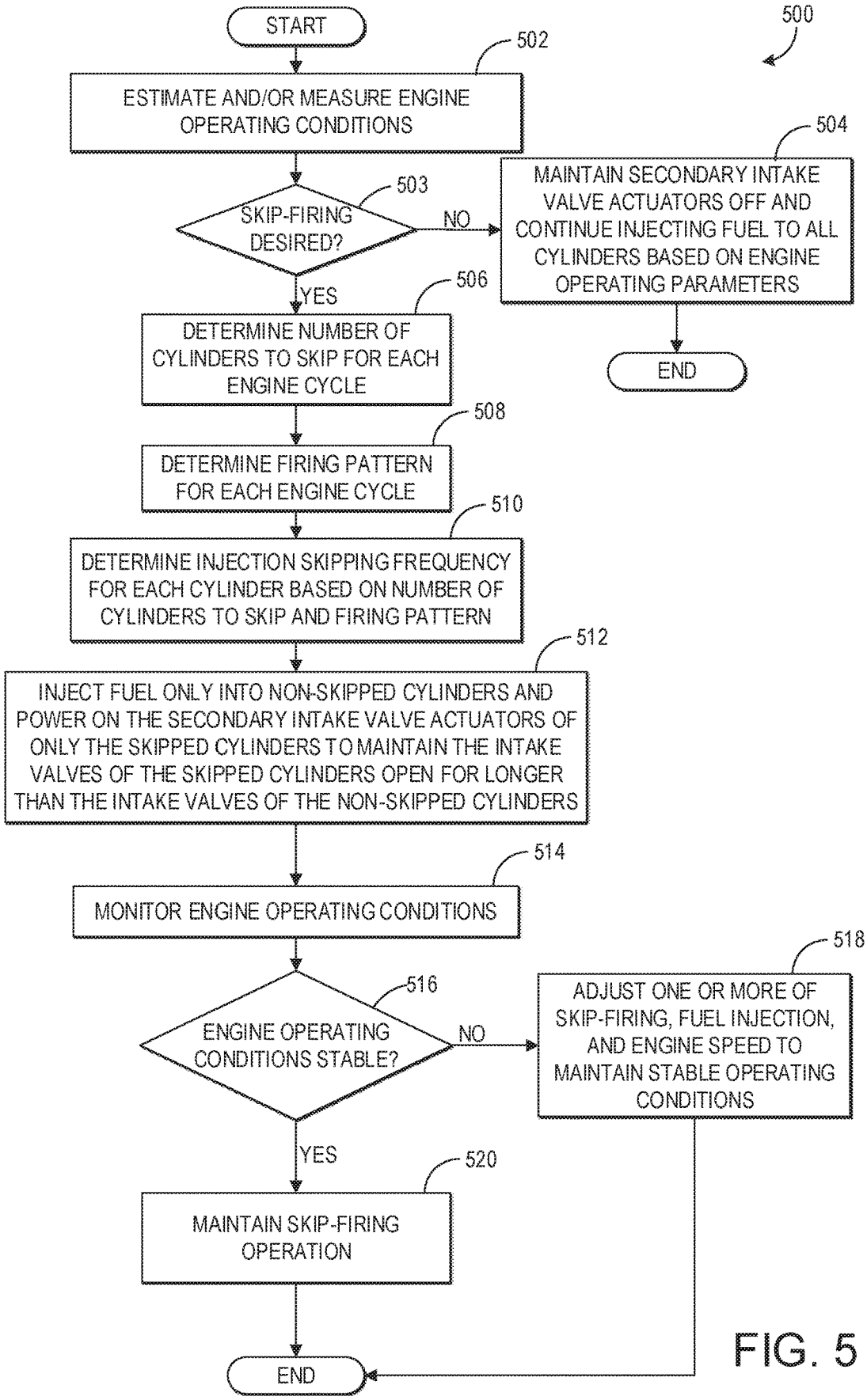
FIG. 5 shows a flow chart of a method for skip-firing an engine and for adjusting intake valve closing timing for cylinders that are skipped during skip-fire operation, according to an embodiment of the invention.
Figure 6:
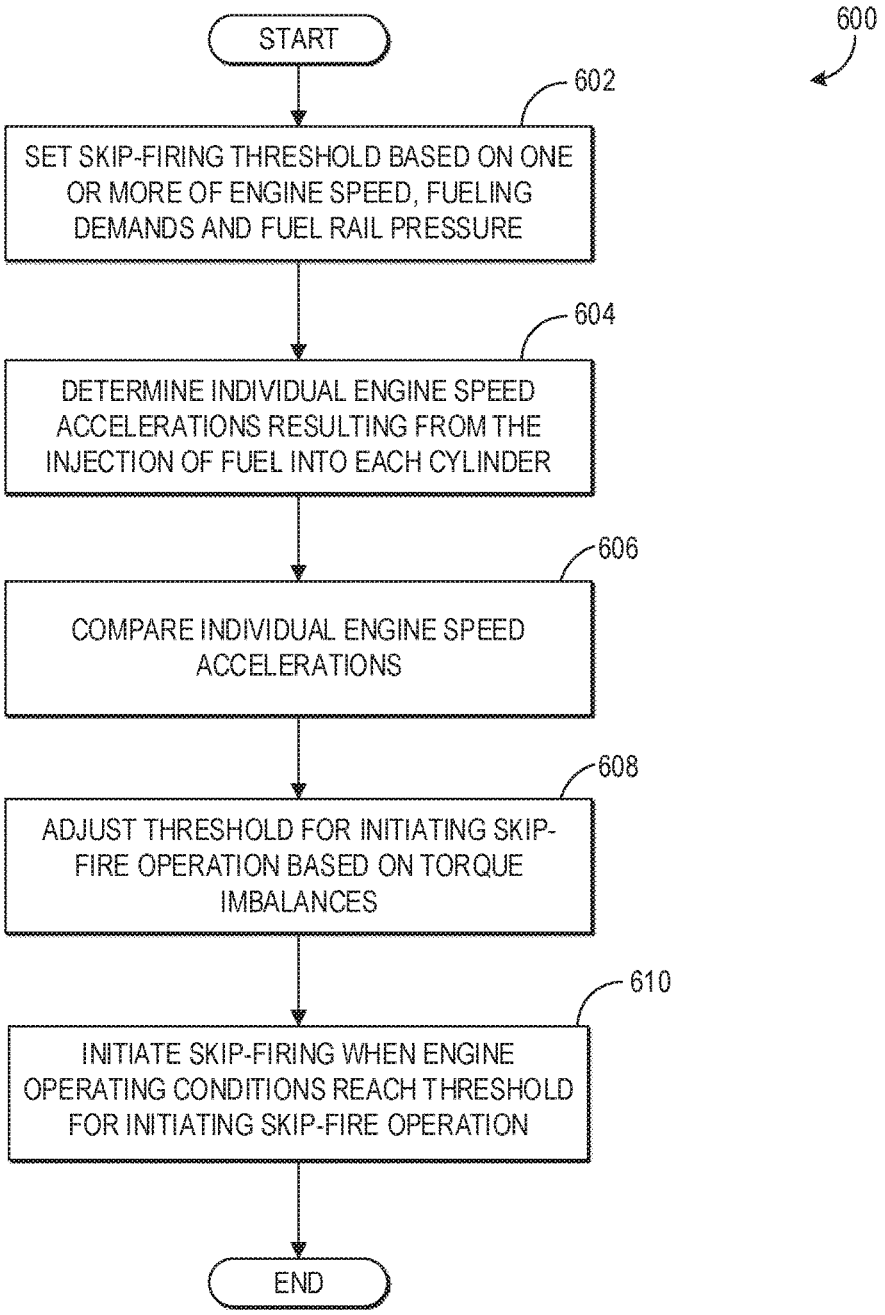
FIG. 6 shows a flow chart of a method for determining when to initiate skip-firing of an engine, according to an embodiment of the invention.
Figure 7:
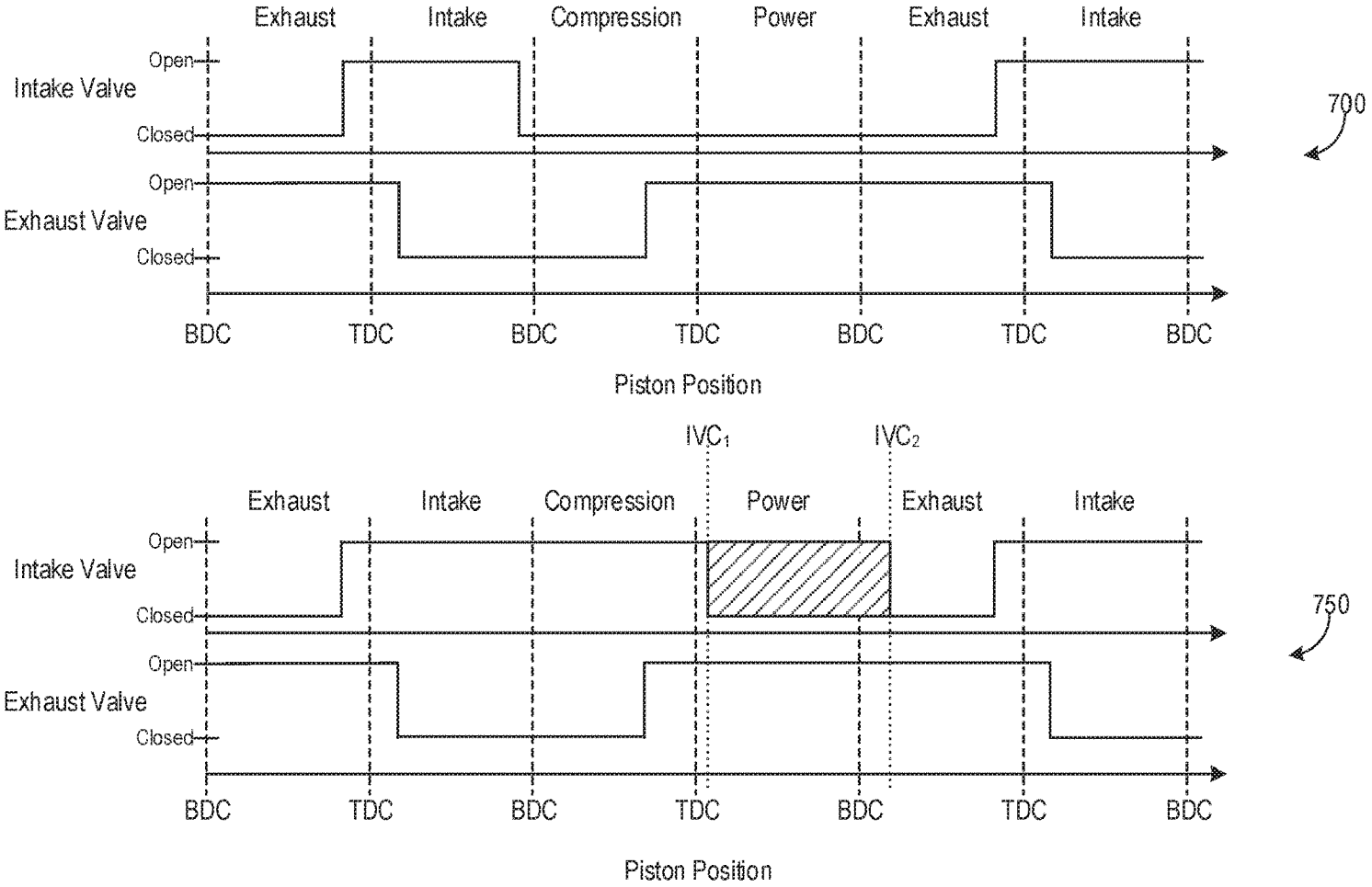
FIG. 7 shows a graph depicting adjustments to intake valve closing timing based on whether the cylinder in which the intake valve is incorporated skips combustion, or undergoes combustion, according to an embodiment of the invention.

FIG. 1 shows an embodiment of a vehicle including an engine. The engine may include one or more cylinders, such as the cylinder shown in FIG. 2A. FIG. 2A additionally shows an intake valve actuator adapted to open and close an intake valve of the cylinder independently of mechanically driven cam lobes. A first example of the intake valve actuator is shown in FIG. 2B, and a second example of the actuator is shown in FIG. 2C. FIG. 3 shows a more detailed example of the engine of FIG. 1, including intake and exhaust valves for each of the cylinders, and the intake valve actuator of FIGS. 2A-2C incorporated within the intake valves. When skip-firing the engine, only some of the cylinders are injected with fuel. FIG. 4 shows an example cylinder firing pattern when skip-firing the engine. FIG. 5 shows a method for skip-firing the engine. In particular, skip-fire may be initiated at lower engine speeds, lower torque outputs, engine idle, lower engine loads, lower fueling demand levels, etc. When skip-firing the engine, intake valves of skipped cylinder may be held open for longer than they would when firing during a typical combustion cycle. For example, FIG. 7 shows how the intake valve normally closes during the compression stroke when the cylinder undergoes a combustion cycle, but does not close or stay closed during the compressions stroke and at least a portion of the power stroke when it is skipped. FIG. 6 further provides an example method for determining when to initiate skip-fire.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the approach for skip-firing an engine, an example platform is disclosed in which the engine may be installed in a vehicle, such as a rail vehicle. For example, FIG. 1 shows a block diagram of an embodiment of a vehicle system 100, herein depicted as a rail vehicle 106 (e.g., locomotive) configured to run on a rail 102 via a plurality of wheels 112. As depicted, the rail vehicle includes an engine 104. In other non-limiting embodiments, the engine may be a stationary engine, such as in a power-generation or power-plant application, or an engine in a marine vessel or other off-highway vehicle propulsion system or systems as noted above.

The engine receives intake air for combustion from an intake passage 114. The intake passage receives ambient air from an air filter 160 that filters air from outside of the rail vehicle. Exhaust gas resulting from combustion in the engine is supplied to an exhaust passage 116. Exhaust gas flows through the exhaust passage, and out of an exhaust stack of the rail vehicle. In one example, the engine is a diesel engine that combusts air and diesel fuel through compression ignition. In other non-limiting embodiments, the engine may additionally combust fuel including gasoline, kerosene, natural gas, biodiesel, or other petroleum distillates of similar density through compression ignition (and/or spark ignition, and/or other forms of ignition such as laser, plasma, or the like).

In some embodiments, the vehicle system may include a turbocharger 120 that is arranged between the intake passage and the exhaust passage. The turbocharger increases pressure of the ambient air drawn into the intake passage in order to provide greater charge air density to increase the mass of air available for combustion to increase power output and/or engine-operating efficiency. The turbocharger may include a compressor (not shown) which is at least partially driven by a turbine (not shown). While in this case a single turbocharger is included, the system may include multiple turbine and/or compressor stages. In another embodiment, the engine system may include a supercharger wherein a compressor or blower is driven mechanically by the engine to compress ambient air in order to provide greater charge density for/during combustion to increase power output and/or engine-operating efficiency. In other embodiments, the engine system may be naturally aspirated receiving fresh air charge for in-cylinder combustion and not include a turbocharger or a supercharger or a blower.

The vehicle system further includes an exhaust treatment system 130 coupled in the exhaust passage downstream of the turbocharger. The exhaust treatment system may include one or more components. In one example embodiment, the exhaust treatment system may include a diesel particulate filter (DPF) 132. In other embodiments, the exhaust treatment system may additionally or alternatively include a diesel oxidation catalyst (DOC), a selective catalytic reduction (SCR) catalyst, a three-way catalyst, a NOx trap, various other emission control devices or combinations thereof. The DPF may be cleaned via regeneration, which may be employed by increasing the temperature for burning particulate matter that has collected in the filter. Passive regeneration may occur when a temperature of the exhaust gas is high enough to burn the particulate matter in the filter. During active regeneration, air-fuel ratio or other operating parameters may be adjusted and/or fuel may be injected and burned in the exhaust passage upstream of the DPF in order to drive the temperature of the DPF up to a temperature where the particulate matter will burn and oxidize more completely.

Further, in some embodiments, a burner may be included in the exhaust passage such that the exhaust stream flowing through the exhaust passage upstream of the exhaust gas treatment device may be heated. In this manner, the temperature of the exhaust stream may be increased to facilitate active regeneration of the exhaust gas treatment device. In other embodiments, a burner may not be included in the exhaust gas stream.

The exhaust treatment system may further include a temperature sensor 133 for indicating a temperature of the exhaust treatment system. Thus, the temperature sensor may be positioned within the exhaust treatment system and configured to measure a temperature of the exhaust treatment system. Outputs from the temperature sensor may be communicated to a controller 148 (e.g., electronic controller having one or more processors) via an electrical connection (e.g., wired or wireless) and the controller may estimate a temperature of the exhaust treatment system based on the outputs received from the temperature sensor. Further, the controller may adjust one or more engine operating parameters such as fuel injection amounts, injection timing, skip-firing patterns, etc., based on the measured exhaust treatment system temperature to maintain the exhaust treatment system to a desired temperature. For example, when regeneration of the DPF is desired, the controller may adjust a skip-firing pattern and/or number of cylinders undergoing skip-fire to increase the exhaust treatment system temperature to facilitate regeneration of the DPF.

The controller may be employed to control various components related to the vehicle system. In one example, the controller includes a computer control system. The controller further includes computer readable storage media (e.g., memory) including code for enabling on-board monitoring and control of rail vehicle operation. The controller, while overseeing control and management of the vehicle system, may receive signals from a variety of sensors 151, as further elaborated herein, to determine operating parameters and operating conditions, and correspondingly adjust various engine actuators 152 to control operation of the vehicle. For example, the controller may receive signals from various engine sensors including, but not limited to, engine speed, engine torque output, engine load, boost pressure, exhaust pressure, ambient pressure, exhaust temperature, knock, misfire, fuel rail pressure, and the like. Correspondingly, the controller may control aspects and operations of the vehicle system by sending commands to various components such as fuel injectors, cylinder valves and cylinder valve actuators, fuel pump, air and/or fuel throttle, and the like.

As shown in FIG. 1, the engine includes a plurality of cylinders 108. Though FIG. 1 depicts an engine with twelve cylinders, other numbers of cylinders are possible. Each cylinder of the engine may include a fuel injector 111. Each fuel injector may inject fuel into the cylinder to which it is coupled at a different time than the other fuel injectors. The order in which each fuel injector fires (e.g., injects fuel into the corresponding cylinder) may be referred to herein as the cylinder firing order. For a single engine cycle, each fuel injector may fire at a different time within the cylinder firing order. For example, each fuel injector may deliver one primary injection (also referred to herein as the "main injection") into the cylinder to which it is coupled in a single engine cycle. In some embodiments, the fuel injectors may also perform additional secondary injections before and/or after the primary/main injection. The injection before (or in front of) the main injection may be referred to herein as the "pre injection," and the injection after the main injection may be referred to herein as "post injection."

As shown by the dotted lines in FIG. 1, the controller is in electrical communication with each fuel injector via a wired or wireless connection. The fuel injector may be an electromagnetically actuated fuel injector that opens and closes responsive to signals (e.g., pulse width modulated signals, PWMs) received from the controller. Thus, the controller adjusts an amount of fuel delivered to each of the cylinders by modulating the command signals sent to the actuator of each fuel injector, which in turn adjusts the "ON" time of the injector actuator or solenoid. When the injector actuator or solenoid of the injector is ON, the injector injects fuel into the cylinder.

In one example, the controller may adjust the fuel injector to either a fully closed first position or a fully open second position. In the fully closed first position, the fuel injector does not inject fuel. However, in the fully open second position, the fuel injector injects fuel. Thus, the controller may inject fuel by adjusting the fuel injector from the fully closed first position to the fully open second position. The controller may adjust the fuel injector to the fully open second position by adjusting a command signal, such as the pulse width of a pulse width modulated signal, sent to the fuel injector. Adjusting of the injector from the first position to the second position may be referred to herein as opening of the injector. Opening of the injector does not include the holding open of the injector, where the injector is held in the fully open second position. Thus, opening of the injector is used to refer to movement of the injector from when it first begins to move away from the first position, until it reaches the second position.

The controller may then hold open the fuel injector in the second position, until the desired fuel injection amount has been injected. Once the desired fuel injection amount has been injected, the controller may then adjust the fuel injector back to the fully closed first position and stop injecting fuel. The desired fuel injection amount may thus comprise a unit fueling, which is the desired amount of fuel (e.g., fuel volume) to be injected during a single injection or single power stroke of the associated engine cylinder. In the description herein "fueling demand" may also be used to refer to the desired fuel injection amount and/or pulse width of a pulse width modulated signal (PWM) of the injector.

However, there may be a delay from when the injector begins to open (begins to move away from the first position towards the second position) until the injector reaches the open second position. Thus, it may take the injector a duration of time to adjust from the first position to the second position and completely open. Fuel may be injected by the injector while it opens, before it reaches the fully open second position. That is, the injector does not need to be in the fully open second position to inject fuel; it may also inject fuel when in a position between the first and second positions.

In some examples, when the injector is commanded to the fully open second position, the desired fuel injection amount may be injected before the injector reaches the fully open second position. In such examples, the injector may operate in what is commonly referred to as the "ballistic region." Thus, when the desired injection amount is less than what would be injected by the injector before the injector reaches the fully open second position, the injector is said to operate in the ballistic region. That is, the ballistic region may represent an amount of fuel that is delivered by the injector while the injector opens (transitions from the first to the second position). Thus, when fueling demand decreases sufficiently, such that the commanded fuel injection amount decreases into the ballistic region of the injector, the fuel injector may only need to partially open to inject the desired amount of fuel.

However, since the injector may only be adjustable to either the first position or the second position, fuel injection accuracy and control is severely reduced when operating in the ballistic region. Further, the amount of fuel injected by the injector while it opens, and therefore in the ballistic region, may depend on fuel rail pressure, the pulse-width of the injector, PWM, and in-cylinder pressure. In particular, the amount of fuel injected while the injector opens may increase for increases in fuel rail pressure and/or the pulse-width of the injector, PWM. As such, fuel metering errors may be exacerbated at higher fuel rail pressures and/or shorter PWMs where the effect of the ballistic region is larger and more profound.

In another example, the controller may adjust the fuel injector to one or more positions between the fully closed first position and the fully open second position. The controller may increase the amount of fuel injected by adjusting the injector closer towards the fully open second position and away from the fully closed first position. The command signal may be in the form of a pulse width modulated signal. By adjusting the pulse width of the signal, the controller may adjust the size of the opening of the fuel injector and/or the duration for which the injector is open.

As explained in greater detail below with reference to FIG. 6, the controller may command for the engine to skip-fire at least one of the cylinders when the desired fuel injection amount per injection decreases into the ballistic region (e.g., decreases below the amount of fuel that would be injected while the injector opens fully to the second position). In this way, the controller may increase the unit fueling for active cylinders to above the ballistic region, thereby increasing fueling accuracy and control.

For example, when all cylinders are firing, the controller may decide to enter the skip-fire mode and skip combustion for some of the cylinders when the commanded fuel injection amount (e.g., command signal sent to each fuel injector, such as the PWM signal) decreases below a threshold. The threshold may represent the switch from the non-ballistic to ballistic region of the injector. For example, the threshold for a given fuel rail pressure may correspond to a commanded injection volume of approximately 200 $mm^3$ to 500 $mm^3$ per injection event, below which the injector operates in the ballistic region, and above which the injector operates in the non-ballistic region. In the non-ballistic region, the desired injection amount is achieved when the injector reaches the fully open second position, or after the injector reaches the fully open second position and is held in the second position. As such, the amount of fuel injected by the injector may be linear with respect to the duration the injector is open in the non-ballistic region. By reducing the number of firing cylinders, the desired torque output (and therefore fuel injection amount) may be distributed amongst fewer cylinders, thus increasing the amount of fuel to be injected by each firing cylinder. As such, the injectors of firing cylinders can be operated in their non-ballistic regions even at lower engine fueling demand levels where they would have operated in their ballistic regions had all of the cylinders been fired.

In some examples, the controller may be independently electrically coupled to each of the fuel injectors. Said another way, the controller may be electrically coupled to each fuel injector individually, through distinct wired or wireless connections. For example, the controller may be coupled to each fuel injector via separate wires. As such, the controller may send individual fuel injection command signals to each of the fuel injectors. In this way, the controller may individually adjust the amount of fuel injected to each cylinder by adjusting the command signal sent to each of the injectors. However, in other examples, the controller may be independently electrically coupled to various subsets of fuel injectors and may vary the amount of fuel injected by the injectors of different sub sets.

The controller may command for different amounts of fuel to be injected to different cylinders. For example, when skip-firing, the controller may command for one or more fuel injectors to not inject fuel during a given engine cycle. The controller may initiate skip-fire when fueling demands and/or engine speed decrease below respective thresholds. Thus, the controller may determine when to initiate skip-fire based on fueling demands. When fueling demands decrease to sufficiently low levels, such as during engine idling, relative fuel metering errors (e.g., the difference between the actual amount of fuel injected and the desired amount of fuel to be injected, compared to the desired amount of fuel to be injected) increase. To reduce such metering errors, skip-firing may be initiated so that fewer cylinders are firing during a given engine cycle, thus increasing the amount of fuel injected to each of the firing cylinders. By increasing the amount of fuel injected to the firing cylinders, fuel metering errors may be reduced, as the metering errors for the injectors is inversely proportional to injection quantity, such that the metering errors increase for decreases in fuel injection quantity.

In some embodiments, as shown in FIG. 1, the engine includes an engine crankshaft torque output sensor 113 for the entire engine, and a torque contribution to the crankshaft from each individual cylinder can be measured and determined based on torque data associated with the specific contributing cylinder. In one example, the torque sensor may be a contact type or contactless type or slip-ring type. Each of the types may use strain gauge, piezo-electric, or other such technologies. The torque sensor may output a voltage which is then received as a voltage signal at the controller. In one embodiment, the controller processes the voltage signal from the torque sensor to determine a corresponding cylinder-by-cylinder torque output for the entire engine, for each full cycle of engine operation, and subsequently adjust engine operation based on the received torque data.

As one example, the controller may infer fuel metering errors in one or more of the cylinders by comparing the cylinder-to-cylinder torque contributions and thereby measuring torque imbalances amongst the cylinders. For example, the torque imbalances may increase for increases in fuel metering errors, as the injector-to-injector variation in fueling, and therefore torque output, increases when there is greater variability in the fuel injections (higher fuel metering errors). The controller may adjust the threshold at which it switches to operating in the skip-fire mode based on the torque imbalances. For example, the controller may increase the fuel threshold at which it initiates skip-fire in response to increased torque imbalance amongst the cylinders. Thus, the fuel demand level at which the controller switches to skip-firing the engine may depend on the torque imbalances amongst the cylinders. In this way, the controller may initiate skip-firing at a higher fuel demand level when the measured torque imbalances are higher than it would at lower torque imbalance levels. For example, when fuel demands are monotonically decreasing, the controller may switch to skip-firing sooner when the measured torque imbalances are higher than it would when the torque imbalances are lower.

Further, the controller may receive an indication of a driver demanded torque and/or engine speed from an input device 150 to which the controller may be electrically coupled via a wired and/or wireless connection. The input device may comprise an electric/electronic controller such as an Engine Control Unit (ECU) which can be used to adjust the fueling level to achieve the desired engine speed and/or engine torque. However, in other examples, the input device may comprise a foot actuated accelerator pedal, or other type of manual input device. In this way, a vehicle operator may set or adjust a desired engine speed and/or engine torque by adjusting the position of the input device. In still further examples, the input device may be an electronic device such as a touch screen through which a vehicle operator may adjust the desired engine speed and/or engine torque. The controller may adjust one or more engine operating conditions based on input received from the input device. For example, the controller may adjust an amount of fuel injected to the engine cylinders based on the driver requested engine speed and/or engine torque.

FIG. 2A depicts an embodiment of a combustion chamber, or cylinder 200, of a multi-cylinder internal combustion engine, such as the engine 104 described above with reference to FIG. 1. The cylinder may be a representative cylinder for cylinders 108 in FIG. 1. Additionally, the cylinder shown in FIG. 2A may be defined by a cylinder head 201, housing the intake and exhaust valves and fuel injector, described below, and a cylinder block 203. In some examples, each cylinder of the multi-cylinder engine may include a separate cylinder head coupled to a common cylinder block.

The engine may be controlled at least partially by a control system including controller 148 which may be in further communication with a vehicle system, such as the vehicle system 100 described above with reference to FIG. 1. As described above, the controller may further receive signals from various engine sensors including, but not limited to, engine speed from a crankshaft speed sensor 209, engine load, boost pressure, exhaust pressure, ambient pressure, $O_2$ levels, exhaust temperature, $NO_x$ emission, engine coolant temperature (ECT) from temperature sensor 230 coupled to cooling sleeve 228, etc. In one example, the crankshaft speed sensor/transducer may be a Hall effect sensor, variable reluctance sensor, linear variable differential transformer, an optical sensor, or other types/forms of speed sensors, configured to determine crankshaft speed (e.g., RPM) based on the speed of one or more teeth on a wheel of the crankshaft. In another example, the crankshaft speed sensor may also determine a position of the crankshaft. Correspondingly, the controller may control the vehicle system by sending commands to various components such as alternator/generator, cylinder valves, air and/or fuel throttle, fuel injectors, etc.

As shown in FIG. 2A, the controller receives a signal (e.g., output) from the crankshaft speed sensor. In one example, this signal (which may be an analog output that includes a pulse each time a tooth of the wheel of the crankshaft passes the crankshaft speed sensor) may be converted by a processor of the controller into an engine speed (e.g., RPM) signal. The controller may then use the engine speed signal to adjust engine operation (e.g., adjust primary fueling to the cylinder) to achieve the required/commanded speed and torque. For example, the controller may determine when to initiate skip-fire based on the engine speed signal. In another example, the controller may adjust a firing pattern (e.g., which cylinders are skipped during a given engine cycle) when skip-firing the engine based on the engine speed signal. In yet another example, the controller may adjust the number of cylinders to be skipped while skip-firing the engine based on the engine speed signal.

The cylinder (i.e., combustion chamber) may include combustion chamber walls 204 with a piston 206 positioned therein. The piston may include a piston ring and/or liner disposed between an outer wall of the piston and the inner wall of the cylinder. The piston may be coupled to a crankshaft 208 so that reciprocating motion of the piston is translated into rotational motion of the crankshaft. In some embodiments, the engine may be a four-stroke engine in which each of the cylinders fires (e.g., fuel is injected into each cylinder) in accordance with a firing order during two revolutions of the crankshaft. In other embodiments, the engine may be a two-stroke engine in which each of the cylinders fires in a firing order during one revolution of the crankshaft.

The cylinder receives intake air for combustion from an intake including an intake runner (or manifold) 210. The intake runner receives intake air via an intake manifold. The intake runner may be configured such that there is one runner per cylinder or such that a single intake runner communicates with multiple cylinders (e.g. one runner per bank of a V-engine which communicates with all cylinders on a bank, wherein the V-engine consists of two runners) of the engine in addition to the one cylinder, for example, or the intake runner may communicate exclusively with that one cylinder.

Exhaust gas resulting from combustion in the engine is supplied to an exhaust system including an exhaust runner 212. Exhaust gas flows through the exhaust runner, to a turbocharger in some embodiments (turbocharger not shown in FIG. 2A) and to atmosphere, via an exhaust manifold. The exhaust runner may further receive exhaust gases from other cylinders of the engine in addition to the single cylinder (as shown), for example.

Each cylinder of the engine may include one or more intake valves and one or more exhaust valves. For example, the cylinder in FIG. 2A is shown including at least one intake valve 214 and at least one exhaust valve 216 located in an upper region of cylinder. In some embodiments, each cylinder of the engine may include at least two intake poppet valves and at least two exhaust poppet valves located at the cylinder head.

The position of the intake valve 214 may be adjusted by a first actuator 218. Similarly, the position of the exhaust valve 216 may be adjusted by a second actuator 220. In some examples, the first and second actuators may be cam lobes that are mechanically driven by the crankshaft. For example, the actuators may be physically coupled to respective camshafts, such that the actuators rotate with their respective camshafts. The camshafts may in turn be driven by the crankshaft via a mechanical coupling with the crankshaft, such as via a gear or belt or chain. In this way, the opening and closing of the intake and exhaust valves may be determined by crankshaft rotation (e.g., crankshaft speed) and may be the same from engine cycle to engine cycle. For example, the intake valve may be driven open by rotation of the crankshaft via a cam lobe at a predetermined instance during piston reciprocation position within the combustion chamber. Similarly the intake valve may close at a different predetermined instance during piston reciprocation position within the combustion chamber. For example, the intake valve may open during the exhaust stroke when the piston is approximately 30 degrees below top dead center (e.g., where top dead center refers to a position where the piston reaches the point of closest approach to the cylinder head) and may close during the compression stroke when the piston is approximately 40 degrees above bottom dead center (e.g., where bottom dead center refers to a position where the piston reaches the point of further approach from the cylinder head).

In such examples where the valve timing is fixed by the crankshaft, a third actuator 240 may be included that actuates the intake valve independently of the first actuator (e.g., cam lobe). The third actuator 240 may be electrically coupled to the controller via a wired or wireless connection, and the controller may send signals to the third actuator to adjust the position of the intake valve independently of the crankshaft position. The actuator may comprise one or more of an electric, electromagnetic, mechanical, pneumatic, or hydraulic actuator. In the example of FIG. 2A, the third actuator 240 is configured as an electromagnetic actuator comprising a solenoid 242 and plunger 246. The controller may send signals to the solenoid to energize the solenoid and provide an electromotive force that drives translational movement of the plunger which in turn drives translational movement of the intake valve.

As depicted in the example of FIG. 2A, the third actuator may be positioned above the intake valve (e.g., above the first actuator) such that the first actuator is positioned between the intake valve and the third actuator. In some examples, the third actuator may be included in the cylinder head. However in other examples, the third actuator may be included above the cylinder head. In yet further examples, as shown in FIGS. 2B and 2C below, the third actuator may be positioned circumferentially around the intake valve. Upon energization of the solenoid by the controller, the plunger is displaced and its movement may cause the intake valve to open as described in greater detail below with reference to FIGS. 2B and 2C.

In this way, the controller may send signals to the actuator to adjust the position of the intake valve independently of the rotation or position of the crankshaft. As such, the controller may adjust the timing of the intake valve opening and closing as desired via the third actuator. For example, the controller may adjust intake valve timing when the cylinder is skipped during skip-fire operation. Specifically, the controller may hold the intake valve open during the intake, compression, and power strokes. As one example, the controller may close the intake valve during the power stroke between 0 and 50 degrees from bottom dead center piston position. By maintaining the intake valve open during the entire compression and a portion or all of the power stroke, pumping losses may be reduced and engine efficiency may therefore be increased. In another example, the controller may hold the intake valve open during the intake, compression, power, and a portion of the exhaust stroke. Thus, the controller may close the intake valve during the exhaust stroke. As such, the intake valve may only be closed for a portion of the exhaust stroke.

In yet further examples, the opening and closing of the intake and/or exhaust valves may be varied cycle to cycle via a variable cam timing system. For example, the engine may utilize engine oil or other fluid to fill an advance or retard chamber of a variable cam timing system, which advances or retards the camshaft relative to the crankshaft, thereby changing the relative timing of intake valve actuation to the crankshaft. Thus, advancing or retarding the opening and closing of the intake and exhaust valves.

The intake and exhaust valve timing may be controlled concurrently or any of a possibility of variable intake cam timing, variable exhaust cam timing, dual independent variable cam timing or fixed cam timing may be used. In other embodiments, the intake and exhaust valves may be controlled by a common valve actuator or actuation system, or an independently variable valve timing actuator or actuation system. Further, the intake and exhaust valves may by controlled to have independently variable lift by the controller based on operating conditions.

In yet further examples, the intake and exhaust valves may be actively driven by the controller and may not be mechanically driven by the crankshaft. In such examples, the first and second actuators may comprise electromagnetic actuators and the controller may vary the signals provided to the first and second actuators to control the opening and closing of the respective intake and exhaust valves. In such examples, the third actuator may not be included, as the controller may vary the position of the intake valve as desired. The position of the intake valve and the exhaust valve may be determined by respective valve position sensors 222 and 224, respectively.

In some embodiments, each cylinder of the engine may be configured with one or more fuel injectors for providing fuel thereto (as shown in FIG. 1). As a non-limiting example, FIG. 2A shows the cylinder including a fuel injector 226. The fuel injector is shown coupled directly to the cylinder for injecting fuel directly therein. In this manner, the fuel injector provides what is known as direct injection of a fuel into the cylinder. The fuel may be delivered to the fuel injector from a high-pressure fuel system including a fuel tank 232, fuel pumps, and a fuel rail (not shown). In one example, the fuel is diesel fuel that is combusted in the engine through compression ignition. In other non-limiting embodiments, the fuel may be gasoline, kerosene, jet fuel, heavy hydrocarbon oils derived from petroleum crudes, heavy non-petroleum hydrocarbon oils, heavy biodiesel, or other petroleum distillates of similar density through compression ignition (and/or spark ignition). In other embodiments, the fuel may be a combination of two or more of these different types of fuel. In yet other embodiments, ignition of the fuel-air mixture is achieved through the use of laser or plasma ignitors or other ignition methods. Further, each cylinder of the engine may be configured to receive gaseous fuel (e.g., natural gas) alternative to or in addition to diesel fuel. The gaseous fuel may be provided to the cylinder via the intake manifold, as explained below, or other suitable delivery mechanism or mechanisms such as multi-port injection of gaseous fuel very close to the intake valve(s) of each cylinder or direct injection of gaseous fuel in to the engine cylinder. In yet another embodiment, the injection of fuel in to each engine cylinder could be direct injection to the combustion chamber (as detailed and discussed in this disclosure) or alternately the fuel could be injected "indirectly" to the combustion chamber via a pre-chamber—such engines are referred to as indirect-injection or pre-chamber combustion engines. Engine designs that use direct injection of the fuel or indirect injection of the fuel may be referred to as traditional internal combustion engines. The skip-fire technology described herein is applicable to both traditional and non-traditional internal combustion engines to sustain combustion timing, combustion quality/stability, and stable engine speed. The skip-fire methods described herein are also applicable to non-traditional combustion engines, such as but not limited to, gasoline direct injection (GDI), low temperature combustion (LTC) such as pre-mix controlled compression ignition (PCCI) or homogeneous charge compression ignition (HCCI), and reactivity controlled compression ignition, (RCCI), to achieve stable and repeatable combustion events, and stable engine speed.

As explained above, the engine may include one or more engine speed sensors (e.g., such as crankshaft speed sensor 209 shown in FIG. 2A). In one example, the crankshaft speed sensor/transducer may be a Hall effect sensor, variable reluctance sensor, linear variable differential transformer, an optical sensor, or other types/forms of speed sensors, configured to determine crankshaft speed (e.g., RPM) based on the speed of one or more teeth on a wheel of the crankshaft. The controller receives a signal (e.g., output) from the crankshaft speed sensor. In one example, this signal (which may be an analog output that includes a pulse each time a tooth of the wheel of the crankshaft passes the crankshaft speed sensor) may be converted by a processor of the controller into an engine speed (e.g., RPM) signal. The controller may then use the engine speed signal to adjust engine operation (e.g., adjust fueling and/or skip-firing operation) to achieve the required/commanded speed and torque.

For example, the controller may adjust one or more engine operating parameters (e.g., an amount of fuel being injected into engine cylinders via one or more fuel injectors) based on the sensed engine speed (which is unstable or fluctuating) in order to maintain the engine speed at a desired engine speed. As explained above with reference to FIG. 1, the controller may additionally determine when to skip-fire the engine and only inject fuel into a subset of the cylinders based on the engine speed. For example, when the engine speed fluctuates and decreases below a threshold, the controller may initiate skip-fire. In this way, fuel metering errors may be reduced allowing for stable engine operation at lower engine speeds resulting in lower fuel consumption.

Turning to FIGS. 2B and 2C, they show two embodiments of the third actuator described above with reference to FIG. 2A. In particular, FIGS. 2B and 2C show examples of how the third actuator may adjust the position of the intake valve independently of cam lobes. In the examples of 2B and 2C, the third actuator is shown positioned circumferentially around the intake valve and actuates the intake valve by pushing or pulling on a knob 254 included on the intake valve. However, it should be appreciated that in other examples, the third actuator may be included within the intake valve, and may adjust the length of the intake valve (and therefore intake valve opening and closing) via energization of the solenoid. For example, the third actuator may comprise a portion of the intake valve, and by energizing the solenoid, the controller may push the plunger away from the solenoid, toward the top/stem of the intake valve, thereby opening the intake valve.

The first actuator is shown configured as a cam lobe in two positions offset by 180 degrees with the third actuator OFF and ON. As shown with the third actuator OFF and the cam lobe in a first position (e.g., 0°), the intake valve is in a fully closed first position. When the cam lobe rotates 180° to a second position (e.g., 180°) the intake valve is in a fully open second position. The degree markings in FIGS. 2B and 2C do not correspond to crank angle or piston angle, but are merely presented to show that the cam lobe is offset by 180 degrees in the two different positions. In the position shown by the actuator OFF and the cam lobe at 0° substantially no intake air enters the cylinder. However, rotation of the cam lobe may cause the intake valve to open while the third actuator is OFF. In the second position where the cam lobe is offset from the first position by 180 degrees, the intake valve is open allowing intake air to enter the combustion chamber. However, when the third actuator is powered on by the controller (e.g., controller 148 described above in FIGS. 1 and 2A), the intake valve is held open by the third actuator, and the cam lobe is free to rotate without influencing the position of the intake valve.

In the example of FIG. 2B, the third actuator is shown configured as a push-type actuator, where the plunger 246 extends away from the solenoid 242 when the solenoid is energized by the controller. However, FIG. 2C shows an example where the third actuator is configured as a pull-type actuator, where the plunger is pulled towards the solenoid when the solenoid is energized by the controller. It should be appreciated that alternative types of actuators may be employed to adjust the position of the intake valve without departing from the scope of the invention.

The first actuator may thus be a cam lobe that is mechanically coupled to a camshaft such that it co-rotates with the camshaft. Thus, the cam lobe and camshaft are locked in rotation with one another. The camshaft and cam lobe may be mechanically driven by the crankshaft via a suitable coupling such as a gear, belt, or chain. The camshaft and cam lobe may rotate only once (360° of rotation) for every two rotations (720°) of the crankshaft. Thus, the cam lobe opens the intake valve for a duration dictated by the shape and geometric profile of the cam lobe and the speed of rotation of the crankshaft, only once (for each engine cylinder) during a four-stroke combustion cycle where the crankshaft completes two full rotations.

FIG. 3 shows an example schematic 300 of the engine of FIG. 1, where the third actuator 240 is included within each cylinder of the engine. Each intake valve 214 may be coupled to a third actuator such that the position of each intake valve may be adjusted via a respective third actuator. The controller is electrically coupled to each actuator for adjusting the position thereof. Further, the controller is electrically coupled to each fuel injector as described above with reference to FIG. 1. The controller may initiate skip-fire by sending signals to one or more of the fuel injectors to not inject fuel during an engine cycle. FIG. 4 shows an example firing pattern for operating in a skip-fire mode. When operating in a skip-fire mode, the controller may send signals to the third actuators of cylinders that are not undergoing combustion to maintain the intake valves open during the compression stroke and at least a portion of the power stroke. Thus, the controller may hold the intake valves open longer than the intake valves would ordinarily be held open by the cam lobes during a normal combustion cycle. The controller may be electrically coupled to each intake valve actuator independently, such that the controller may adjust the position of each actuator individually as desired.

As described in greater detail below with reference to FIG. 5, the controller may determine when to initiate the skip-fire mode based on one or more of engine speed, driver demanded torque, driver demanded speed, fueling demands, temperature of an exhaust after-treatment system (e.g., exhaust treatment system 130 described above in FIG. 1), etc. Additionally or alternatively, the controller may determine when to initiate skip-fire and/or may adjust the skip-fire based on fuel rail pressure and the pulse-width modulation of the injector (PWM). The pressure of a fuel rail 336 may be estimated by the controller based on outputs from a pressure sensor 358 coupled in the fuel rail. The fuel rail may be supplied with fuel from the fuel tank 232 via a high-pressure fuel pump 334. The controller may regulate an amount of power supplied to the fuel pump, and therefore an amount of fuel supplied to the fuel rail. In particular, the controller may control operation of the fuel pump to maintain a desired fuel rail pressure in the fuel rail. The fuel rail may in turn supply fuel to the fuel injectors for injection into the cylinders.

The desired fuel rail pressure and the pulse-width of the injector, PWM, may depend on one or more of the engine load, desired torque output, desired engine speed, etc. Thus, the desired fuel rail pressure and the pulse-width of the injector, PWM, may be set to achieve the desired torque output. For example, the controller may increase the desired fuel rail pressure and/or the injector pulse-width command for increases in engine load and desired torque output. The desired fuel rail pressure and the injector pulse-width, PWM, may be set to decreased levels by the controller during, for example, engine idle and/or low engine loads.

In this way, the controller may infer the injection amount based on the fuel rail pressure and the corresponding PWM command. As such, the controller may determine when to initiate skip-fire, and how many cylinders to skip-fire during the skip-fire operation, based on the fuel rail pressure and the injector PWM command. For example, the controller may initiate skip-fire operation when the injector PWM pulse-width for a given fuel rail pressure decreases below a threshold. The controller may then increase the number of cylinders to skip-fire for continued decreases in the injector PWM pulse-width below the threshold for a given fuel rail pressure.

Turning to FIG. 4 it shows an example firing pattern for an engine 404 in a skip-fire mode during four subsequent complete engine cycles. Engine 404 may be the same or similar to engine 104 described above with reference to FIGS. 1 and 3. Firing cylinders are denoted by dashed lines, while skipped cylinders are depicted without dashed lines. In the example of FIG. 4, the engine is shown as a twelve cylinder engine with each cylinder labelled 1-12. As shown in FIG. 4, the cylinders may alternate back and forth between firing and skipping for subsequent engine cycles. The alternating firing and skipping strategy ensures that no cylinder is running too cold due to continued, long-term, or extended periods of operation in skip-fire mode. An engine cycle is defined herein as two complete rotations of the crankshaft (720 degrees of rotation) for a four stroke engine.

Thus as shown for a first engine cycle 410, odd number cylinders 1, 3, 5, 7, 9, and 11 may fire, while even number cylinders 2, 4, 6, 8, 10, and 12 may be skipped. Then, during a second engine cycle 420, which immediately follows the first engine cycle, the odd number cylinders are skipped while the even number cylinders fire. Similarly, during a third engine cycle 430 which immediately follows the second engine cycle, odd number cylinders go back to firing, while the even number cylinders are skipped. During a fourth engine cycle 440, which immediately follows the third engine cycle, the odd number cylinders are skipped as in the second engine cycle, and the even number cylinders fire.

As used herein, a "firing" cylinder is used to describe a cylinder in which fuel is injected and combustion occurs during the four stroke combustion cycle of the cylinder. Thus, when a cylinder "fires" it is injected with fuel via a fuel injector, and undergoes combustion. Further, the term "skip" is used to describe a cylinder in which fuel is not injected and combustion does not occur during the four stroke combustion cycle of the cylinder.

Thus in the example firing pattern depicted in FIG. 4, cylinders that are skipped (e.g., do not undergo combustion) during a given engine cycle, will be injected with fuel and undergo combustion during the immediately subsequent engine cycle. In this way, each cylinder alternates back and forth between firing and skipping from engine cycle to engine cycle. More simply, each cylinder fires every other engine cycle.

However, it should be appreciated that the firing pattern depicted in FIG. 4 is only one example of a firing pattern that may be employed during skip-fire operation. A controller (e.g., controller 148 described above in FIGS. 1-3) may fire and skip cylinders in different patterns than the pattern shown in FIG. 4. Further, the controller may adjust the firing pattern and/or the number of cylinders to skip during skip-fire operation based on engine operating conditions. For example, the controller may skip more cylinders when fueling demands are lower than when the fueling demands are higher. Thus, when fueling demands are low enough that the controller determines skip-fire is desired, the controller may subsequently adjust the number of cylinders being skipped and/or which cylinders to skip based on engine operating conditions in conjunction with the skip fire logic incorporated in the ECU controls program/code. As described in greater detail below, the number of cylinders skipped during skip-fire operation may influence the firing pattern. For example, in FIG. 4, six cylinders are skipped for each engine cycle. Thus, each cylinder may fire on every other engine cycle. However, when more cylinders are skipped, the frequency at which a cylinder fires may decrease. For example, if eight cylinders are skipped for each engine cycle, a cylinder may only fire on every third engine cycle. In still further examples, the frequency at which a cylinder fires may not be regular. That is, the cylinders may fire in a non-repeating manner that may be random, or may be determined by the controller dynamically based on changing engine operating conditions.

Moving on to FIG. 5, it shows a flow chart of a method 500 for skip-firing an engine (e.g., engine 104 described above in FIGS. 1-3) based on fueling demands and for adjusting the intake valve closing timing of skipped cylinders when skip-firing the engine. As explained above, at least one fuel injector (e.g., fuel injector 111 described above in FIGS. 1 and 3) may be coupled to each cylinder (e.g., cylinders 108 described above in FIGS. 1 and 3) of the engine. However, when fueling demands decrease, such as when the speed or torque demanded by a vehicle operator decreases, the amount of fuel injected by the injectors decreases. Fuel metering errors may increase at lower fuel injection quantities. That is, the fuel injectors may be more inaccurate at lower fuel injection quantities which correspond to injector operation in the ballistic region. Accordingly, when fueling demands decrease below a threshold, skip-firing may be initiated and fuel is not injected to at least one of the cylinders. By skip-firing the engine, the total fuel quantity to be injected by all of the cylinders collectively during a given engine cycle is distributed amongst fewer cylinders, increasing the amount of fuel injected by each firing cylinder, and thereby decreasing fuel metering errors and thereby operating the injectors coupled to the firing cylinders in the non-ballistic mode.

Instructions for carrying out method 500 and the rest of the methods included herein may be executed by a controller (such as controller 148 shown in FIGS. 1-3) based on instructions stored in the memory of the controller and in conjunction with signals received from sensors of the engine system, such as the sensors described above with reference to FIGS. 1-3 (e.g., crankshaft speed sensor 209). The controller may employ engine actuators of the engine system (such as actuators of fuel injectors) to adjust engine operation, according to the methods described below.

At 502, the method includes estimating and/or measuring engine operating conditions. Engine operating conditions may include one or more of engine speed, engine torque output, driver demanded torque, driver demanded speed, fuel rail pressure, estimated fuel quantity, temperature of an exhaust after-treatment system (e.g., exhaust treatment system 130 described above in FIG. 1), or the like.

At 503, the method includes determining whether it is desired to initiate skip-fire. In particular, the method 500 at 503 comprises determining whether one or more fuel injectors are operating, or will operate, in their ballistic region. That is, the method 500 at 503 comprises determining whether the desired fuel injection amount is, or will be less than the amount of fuel actually injected by the injector while the injector opens, before it reaches a fully open second position. Thus, the method 500 at 503, comprises comparing the desired injection amount to the ballistic region of the injector. When the desired injection amount is within the ballistic region (less than the actual amount of fuel that will be, or has been, injected while the injector opens fully to the second position), the controller may determine that it is desired to skip-fire one or more engine cylinders. However, if the desired injection amount is above the ballistic region, then the controller may determine that skip-firing is not desired.

The desired fuel injection amount may comprise a desired unit fueling, which is a desired amount of fuel to be injected during a single injection or during a single power stroke of an associated engine cylinder in which the injector is positioned for injecting fuel. The desired fuel injection amount or PWM command may be determined by the controller based on one or more engine operating conditions, such as engine speed and fuel rail pressure, and a desired torque, such as a driver demanded torque. As described above in FIG. 1, the desired torque output may be set by a vehicle operator via a lever or other input device (e.g., input device 150 described above in FIG. 1). Specifically the controller adjusts the desired fuel injection amount to achieve the desired torque output. Thus, the controller determines, based on engine operating conditions, how much fuel to inject to achieve the desired torque output.

In particular, the desired fuel injection amount may increase for decreases in engine speed, assuming relatively constant power output, and vice versa. That is, the desired fuel injection amount may be directly proportional to the desired torque output, where the actual torque output may change depending on changes in engine speed.

The controller may additionally determine the ballistic region, and therefore when to initiate skip-fire operation, based on fuel rail pressure and the injector pulse-width (PWM). For example, as described above with reference to FIG. 3, the controller may initiate skip-fire operation when the PWM at a given fuel rail pressure decreases below a threshold. As explained above with reference to FIG. 3, the injection quantity is proportional to fuel rail pressure and the injector pulse-width command (PWM). Fuel rail pressure and the injector PWM (which is continuously monitored by the controller) may be used therefore to infer the injection amount. Thus, low fuel rail pressures and/or shorter injector PWM correspond to engine operating conditions of idle (no load) and light loads. Under these conditions the required injection quantity is substantially small or low (less than 5% to 10% of maximum injection quantity required to deliver/meet full load operation of the engine). Thus, the controller may determine when to initiate skip-fire operation and determine the firing pattern and number of cylinders to skip based on the fuel rail pressure and the injector PWM pulse-width. For example, the controller may skip more cylinders for higher fuel rail pressures and/or shorter injector PWM pulse-width. In one example, engine idle operation (at low engine RPM) can be achieved and sustained by skipping 6 or 8 cylinders of a 12 cylinder engine.

As explained above with reference to FIG. 1, the actual fuel flow rate out of the injector may increase for increases in fuel rail pressure and/or decreases in in-cylinder pressure. Thus, the amount of fuel that is injected before the injector reaches the fully open second position (the ballistic region) increases for increases in fuel rail pressure and/or decreases in in-cylinder pressure. As such, the fuel injectors may operate in the ballistic region at higher desired fuel injection amounts for increases in fuel rail pressure and/or decreases in in-cylinder pressure. More simply, for monotonic decreases in the desired fuel injection amount when not skip-firing, the controller may switch to skip-firing sooner at higher fuel rail pressures and/or longer injector PWM pulse-widths.

In another example, the controller may initiate skip-fire in response to engine speed decreasing below a threshold. Additionally or alternatively, the controller may determine when to initiate skip-fire based on engine load. Engine load may include auxiliary loads from an alternator and other electrical devices. The controller may initiate skip-fire in response to engine loads decreasing below a threshold. In yet further examples, the controller may determine whether skip-fire is desired based on one or more of driver demanded engine speed, and cylinder-to-cylinder fuel injection variations (e.g., cylinder-to-cylinder torque output variation). The controller may initiate skip-fire responsive to the engine load decreasing below a load threshold, engine idling, braking, dynamic braking and/or abnormal conditions such as faulty (e.g., degraded) injector or injectors, faulty engine cylinder or cylinders, and such others. Thus, the skip-fire technique as described in this disclosure can be used to "temporarily" correct or remedy or compensate for unstable engine operation caused by certain hardware and/or software failures or defects or faults in the engine system. The ECU (engine controller) is programmed to recognize that skip-fire has been activated to compensate for an engine hardware and/or software problem. The ECU then calls for a service interruption to implement a "permanent" corrective action or fix. The "temporary" skip-fire remedy/correction is continued until the engine can be serviced at the earliest possible opportunity.

The method described below in FIG. 6 provides more details on how the controller may determine when to initiate skip-fire. As one example, skip-fire may be desired during engine-idle. As another example, skip-fire may be desired at lower engine speeds even when the engine is not idling, lower torque demands, lower fueling demands, etc.

If skip-fire operation is not desired (e.g., fueling demands are greater than the threshold), then the method continues to 504. At 504, the method includes maintaining secondary intake valve actuators (e.g., third actuator 240 described above in FIGS. 2A-3) OFF and continuing to inject fuel to all of the cylinders based on engine operating parameters. By maintaining the secondary intake valve actuators OFF, the intake valves may be actuated (e.g., opened and closed) via actuators that are mechanically driven by a crankshaft.

Thus, the method at 504 comprises driving intake valve opening and closing via the crankshaft.

Alternatively at 503, if skip-fire is desired, then the method continues to 506 which comprises determining a number of cylinders to skip for each engine cycle. Thus, the controller may determine how many cylinders to skip when skip-fire is desired based on one or more engine operating conditions. For example, the controller may skip more cylinders for decreases in fueling demands, driver demanded torque, etc. Thus, the controller may determine how many cylinders to skip based on the total amount of fuel to be injected during a given engine cycle by all of the cylinders collectively. In one example, the controller may skip sufficiently many cylinders so that all of the firing cylinders inject more than a threshold amount of fuel. The threshold amount of fuel may comprise an amount of fuel sufficient to maintain the fuel injectors in their non-ballistic region. For example the non-ballistic region may comprise single injections by the fuel injectors that are greater than approximately 500 $mm^3$. However, in other examples, for a given fuel rail pressure, the non-ballistic region may represent a range of unit fueling amounts in a range between 200 and 800 $mm^3$. Thus, given the total amount of fuel to be injected during a given engine cycle, the controller may determine how many cylinders should be skipped to ensure that, for the fuel injectors that are injecting fuel during the engine cycle (e.g., non-skipped cylinders), the injectors operate in their non-ballistic regions. In this way, fuel metering errors may be reduced since fuel injectors are more inaccurate when operating in their ballistic region than their non-ballistic region. That is, fuel injectors may have more percentage variability from injection to injection and injector to injector when operating in their ballistic region (lower fuel injection quantities) than their non-ballistic region. By maintaining the fuel injectors in their non-ballistic regions and thereby reducing fuel metering errors, injection consistency and repeatability may be increased, and thus emissions and unstable engine operation may be reduced.

After determining how many cylinders to skip, the method may then continue from 506 to 508 which comprises determining a firing pattern for each engine cycle. An example firing pattern for a twelve cylinder engine when skipping six of the cylinders is described above with reference to FIG. 4. The skip-fire pattern may be determined to ensure that any injector or injectors do not get damaged. For example, the controller may alternate between specific injector(s) firing and non-firing. By alternating the injector(s) between firing and skipping, and thus only skip-firing the injector(s) every other engine cycle, overheating of the injector(s) and/or excessive lacquer/gum build-up on the injector(s) and/or overly dry re-start during post-skip operation may be prevented. When not injecting fuel into the cylinder during skip-fire operation, excessive temperatures inside the injector-nozzle may result in fuel lacquering/gumming in the nozzle bore, and subsequent needle seizure in the nozzle bore. Hence, by limiting the skip-fire duration and/or skip-fire frequency for each cylinder, injection overheating may be prevented. Also, avoiding long periods (or multiple cycles) of skip-fire ensures that none of the engine cylinders get too cold due to non-combustion. Alternating between firing and skip-firing between engine cylinders helps with uniform wear and tear of the engine cylinders. Thus, the overall performance and life of the engine are not compromised due to skip-fire mode.

The method may then continue from 508 to 510 which comprises determining an injection skipping frequency for each cylinder based on the number of cylinders to skip for each engine cycle and the firing pattern for each engine cycle. For example, as shown in the example of FIG. 4, the controller may skip cylinders at a regular periodicity. The controller may skip cylinders at a regular frequency when the number of cylinder to skip and/or firing pattern is not changing from engine cycle to engine cycle. As one example, when the controller is skipping half of the cylinders per engine cycle the controller may fire a given cylinder on every other engine cycle, such that all of the cylinders alternate back and forth between firing and skipping on consecutive engine cycles.

However, it should be appreciated that in other examples, the controller may skip cylinders in a non-regular manner, such that the firing pattern for each engine cycle may be different. In yet further examples, the controller may determine the number of cylinders to skip and/or the firing pattern for each engine cycle individually based on the engine operating conditions leading up to and/or existent at the beginning of the next engine cycle. In this way, the controller may dynamically adjust one or more of the number of cylinders skipped and/or the firing pattern for each engine cycle based on changes in the engine operating conditions from the previous engine cycle. In other examples, the controller may update the firing pattern and/or number of cylinder to be skipped at a frequency less than every engine cycle (e.g., every five engine cycles).

The method may then continue from 510 to 512 which comprises injecting fuel into only the non-skipped cylinders and powering ON the secondary intake valve actuators of only the skipped cylinders to maintain the intake valves of the skipped cylinders open for longer than the intake valves of the non-skipped cylinders. Thus, when skip-firing the engine, the controller may send electric control signals (e.g., via pulse width modulation) to the secondary intake valve actuators of non-firing cylinders (e.g., cylinders which are not being injected with fuel during a given engine cycle) to remain open for longer than the intake valves are open when undergoing combustion. Thus, the closing timing of the intake valves for firing cylinders may be the same during the skip-fire mode as during normal combustion where all of the cylinders are firing. Thus, when not skip-firing the engine the closing timing of the intake valves is not retarded, and for firing cylinders during skip-fire mode, the closing timing of the intake valve is not retarded. That is, the intake valve closing timing of skip-fire cylinders is retarded relative to the closing timing of firing cylinders, such that the intake valve are held open for longer on skip-firing cylinders than for firing cylinders.

In particular, and as discussed in greater detail below with reference to FIG. 7, the intake valves may be held open during the entire compression, a portion or all of the power stroke, and in some examples, for a portion of the exhaust stroke. The controller may hold open the intake valves by sending an electric control signal to a solenoid (e.g., solenoid 242 described above in FIGS. 2A-2C) to open the intake valve, in examples where the secondary intake valve actuator is configured as an electromagnetic actuator. However, the controller may maintain the intake valve actuators of the firing cylinder OFF, such that the intake valve timing of the firing cylinders may be dictated by crankshaft rotation, in examples where intake valve actuation is driven by rotation of the crankshaft (e.g., via camshaft and cam lobes). By holding the intake valves of the non-firing (e.g., skipped) cylinders open during the compressions and power stroke, pumping losses associated with compressing and expanding a fixed mass of in-cylinder air may be reduced.

The method may then continue from 510 to 512 which comprises monitoring engine operating conditions. Thus, while skip-firing, the controller may continue to monitor engine operating conditions to determine if the skip-firing should be adjusted. Accordingly at 516, the method includes determining if engine operating conditions are stable. For example, the method at 516 may comprise determining if one or more of engine speed, exhaust temperature, power/torque output, torque imbalances, fuel rail pressure, and fuel injector PWM pulse-width are within respective desired/tolerable ranges. If one or more of the above engine operating conditions are outside of their desired/tolerable ranges, the controller may responsively adjust skip-firing operation. Thus, the method may continue from 516 to 518 which includes adjusting one or more of skip-firing, fuel injection, and engine speed to maintain stable operating conditions if it is determined that engine operating conditions are not stable at 516. For example, the controller may increase the exhaust temperature when it is desired to regenerate a particular filter (e.g., DPF 132 described above in FIG. 1). For example, when the exhaust temperature is less than a threshold, the controller may attempt to increase exhaust temperature by one or more of reducing the total engine airflow rate, increasing the total fueling, and retarding the combustion event. When activation of the exhaust after-treatment system is not desired (e.g., catalytic reaction light-off energy not required) skip-fire may be enabled. However, when activation of the exhaust after-treatment system is needed and additional fuel is required to light-off the catalytic reaction, skip-fire may be disabled, and all cylinders may inject fuel into their respective cylinders.

In another example, if activation of the exhaust after-treatment system is desired while the controller is skip-firing one or more engine cylinders, the controller may reduce the number of firing cylinders (increase the number of skip-fired cylinders) to increase the amount of fuel injected into each of the firing cylinders to run the firing cylinders at a richer air/fuel ratio and achieve a hotter exhaust temperature. The method then ends.

Alternatively if at 516 engine operating conditions are stable, the method may continue to 520 which includes maintaining skip-firing operation. The method then ends.

Turning to FIG. 6, it shows a method 600 for determining when to initiate skip-fire. Thus, the controller may execute the method 600 at step 503 of method 500 described above in FIG. 5. The method begins at 602 which comprises setting a skip-firing threshold based on one or more of engine speed, fueling demands, fuel rail pressure, and fuel injector PWM pulse-width. In particular, the threshold may represent the actual amount of fuel delivered by the injector while the injector opens. Thus, the threshold may be the ballistic region of the injector, and in particular, the fuel injection amount where the injector switches between the ballistic and non-ballistic regions. Said another way, the threshold may represent the amount of fuel actually injected by the injector prior to the injector reaching the fully open second position. The controller may initiate skip-fire operation responsive to the desired fuel injection amount decreasing below the threshold. As explained above with reference to FIG. 5, the threshold (e.g., ballistic region) may depend on fuel rail pressure, injector PWM pulse-width, and/or in-cylinder pressure. Thus, the controller may set the threshold based on fuel rail pressure, injector PWM pulse-width, and/or in-cylinder pressure. In particular the threshold may increase for greater differences between the fuel rail pressure and the in-cylinder pressure, when the fuel rail pressure is greater than the in-cylinder pressure. That is, more fuel may be injected as the fuel rail pressure becomes increasingly higher than the in-cylinder pressure. In another example, the threshold may increases for decreases in the pulse-width signal (PWM) below a pre-defined, lower threshold pulse-width signal (which may correspond to operation in the ballistic region, in one example). The controller may additionally or alternatively initiate skip-fire responsive to the engine load decreasing below a load threshold, unstable engine speed or speed fluctuations exceeding a set acceptable target, engine idling, braking, and dynamic braking.

At 604, the method includes determining the crankshaft speed accelerations (torque output) of individual engine-cylinders resulting from the injection of fuel into each cylinder. For example, every time fuel is injected into a cylinder, instantaneous engine speed may increase (and accordingly the acceleration of the engine speed increases proportional to injected fuel quantity). The controller may receive the engine speed signal from an engine speed sensor (e.g., speed sensor 209 described above in FIG. 2A) and/or a torque sensor during all the injection events and then correlate each engine speed acceleration (e.g., each peak in engine speed) to each fuel injector/cylinder based on the known firing order of the cylinders. As a result, the controller may make a logical determination of the individual engine speed accelerations (torque contributions) for each fuel injector/cylinder based on logic rules that are a function of the received (e.g., measured) engine speed signal and the known firing order.

At 606, the method includes comparing the individual engine speed accelerations or torque contributions for each fuel injector/cylinder. Differences in cylinder to cylinder torque output may be used to indicate an amount of fuel injected by each injector since torque output is directly proportional to fueling. Torque imbalances, or cylinder to cylinder variations in torque output, may therefore increase for increases in injector metering errors and injector to injector variation. Thus, fuel metering errors may be monitored by analyzing torque imbalances amongst the different cylinders.

Thus, at 608 the method comprises adjusting the threshold for initiating skip-fire operation based on the torque imbalances. For example, when torque imbalances increase, the threshold may be adjusted to a higher engine speed, such that if engine speed is decreasing, skip-fire is initiated sooner than it would have been if the threshold had been set at a lower engine speed.

At 610 the method comprises initiating skip-firing when the engine operating conditions reach the threshold for initiating skip-fire operation. In this way, the controller may initiate skip-fire at different engine speeds, fueling demands, etc., depending on the amount of variation in cylinder to cylinder injection quantity. The method then ends.

Moving on to FIG. 7, it shows two graphs depicting changes in intake valve closing timing when a cylinder undergoes combustion compared to when the cylinder is skipped during skip-fire operation. In particular, FIG. 7, shows how the intake valve is held open longer when it is skipped than when it is fired. A first graph 700 depicts changes in the position of an intake valve and exhaust valve of a cylinder undergoing combustion, and a second graph 750 depicts changes in the position of the intake and exhaust valve while the cylinder is skipped and does not undergo combustion. In both of the graphs, piston position is shown along the horizontal axis. The piston reciprocates between bottom dead center (BDC) and top dead center (TDC). Since the piston drives rotational motion of a crankshaft, piston position can be converted to rotational angle of the crankshaft. For example, if TDC is defined as 0° then BDC could be defined as 180° relative to TDC. As another example, when the piston is halfway between TDC and BDC as it moves towards BDC, it may be defined as being 90° relative to TDC. Thus, a complete 360° rotation of the crankshaft occurs when the piston reciprocates from TDC to BDC and back to TDC. As described above, a complete engine cycle for a four stroke engine occurs for two full rotations (720°) of the crankshaft.

When the engine is not skip-firing and all cylinders undergo combustion during an engine cycle, the intake valve may be actuated by a cam lobe (e.g., first actuator 218 described above in FIGS. 2A-3) mechanically coupled to a (e.g., camshaft 252 described above in FIGS. 2B and 2C) and driven by rotation of a crankshaft. Thus, the opening and closing timing of the intake valve may be fixed engine cycle to engine cycle. However, when the cylinder is not firing during skip-firing operating, the intake valve may be actuated by an electromagnetic actuator (e.g., third actuator 240 described above in FIGS. 2A-3). As such, the controller may vary the closing timing of the intake valve as desired via the electromagnetic actuator.

As depicted in the first graph, the intake valve may open during the exhaust stroke before the piston reaches top dead center (TDC). The intake valve may open at an angle of approximately 15 degrees from top dead center. However, in other examples, the intake valve may open at an angle within a range of angles between 0 and 30 degrees below/after top dead center. In the example of FIG. 7, the intake valve closes during the intake stroke, before the piston reaches BDC. Thus, in the example of FIG. 7, the engine may be configured as a Miller cycle engine.

However, in other examples, the intake valve may remain open during the intake stroke, and may then close during the compression stroke. For example, the intake valve may close at approximately 25 degrees above/after BDC during the compressions stroke. However, in other examples, the intake valve may close at an angle within a range of angles between 0 and 50 degrees above bottom dead center.

However, when the cylinder is skipped during skip-fire operation, and fuel is not injected into the cylinder, the intake valve may be closed later than it would be closed when undergoing combustion. For example, as shown in the second graph, the intake valve may be held open during the entire compression stroke, a portion or all of the power stroke, and in some examples, a portion of the exhaust stroke. The shaded area in the second graph depicts a range of piston positions at which the intake valve may be closed during skip-fire operation. For example, the intake valve may be closed at any piston position included within the range of piston positions defined in the example of FIG. 7 between a first closing position, $IVC_1$, and a second closing position, $IVC_2$. $IVC_1$ may correspond to a position of the piston during the power stroke, where the piston is moving towards BDC, b 5 degrees after TDC. $IVC_2$ may correspond to a piston position approximately 20° after BDC, where the piston is moving towards TDC during the exhaust stroke. Thus, the intake valve may be closed during the power or exhaust stroke. The intake valve may be closed at any point during the power stroke while the piston is anywhere between TDC and BDC. In some examples, the intake valve may be closed during the exhaust stroke at any point up to the piston reaching 20° after BDC. Thus the intake valve is closed before the piston reaches 20° after BDC.

In some examples, a controller (e.g., controller 148 described above in FIGS. 1-3) may adjust the closing time of the intake valve during skip-fire mode based on one or more of exhaust gas temperature, exhaust oxygen concentration, commanded fueling, engine speed, and power demand. Thus, the controller may adjust when the intake valve for a non-firing, skipped cylinder closes based on engine operating conditions to reduce pumping losses and increase engine efficiency.

In this way, technical effects of reducing emissions and reducing fuel consumption are achieved by skip-firing the engine and holding the intake valves of skipped cylinders open further into their compressions strokes. In particular, by initiating skip-fire not just during engine idle, but also during low speed and/or low torque conditions, more consistent and more accurate fuel injection by fuel injectors is achieved. Thus, by reducing the number of cylinders firing, the amount of fuel injected by each firing cylinder may be increased to maintain the fuel injectors in their non-ballistic regions. In doing so, the accuracy of the firing fuel injectors may be maintained even at lower engine speeds, resulting in more consistent and reliable in-cylinder pressures and temperatures, along with stable engine speed. As a result, emissions may be reduced and fuel consumption may be reduced. Further, operating in the non-ballistic region of the fuel injectors increases engine reliability and durability. Further, skip-firing operation allows for more dynamic control of exhaust gas temperature, which in turn promotes more consistent control and consistent operation of exhaust after-treatment devices, increasing both performance and longevity of those devices.

Further, by holding the intake valves of non-firing cylinders open further into the compression and potentially into the power strokes when skip-firing the engine, power losses associated with the piston compressing and expanding a fixed mass of in-cylinder air are reduced. Thus, engine efficiency and fuel consumption may be improved by holding the intake valves of the non-firing cylinder open for longer than they would be during a normal combustion cycle where fuel is injected.

As one example, a method for an engine comprises: skip-firing the engine when fueling demands are less than a threshold; and holding open intake valves of skipped cylinders for a greater duration than intake valves of firing cylinders. The method may further comprise adjusting the threshold based on cylinder to cylinder torque imbalances, where the threshold is increased for increases in the cylinder to cylinder torque imbalances. In one example, the method may further comprise adjusting the threshold based on fuel rail pressure and/or fuel injector PWM pulse-width, where the threshold increases for increases in fuel rail pressure. In another example, the intake valves of the skipped cylinders are held open via actuators controlled by an engine controller and coupled to the intake valves, and where the actuators comprise one or more of electric, mechanical, pneumatic, hydraulic, and/or electromagnetic. Further, the actuators may adjust the position of the intake valves independently of a cam timing system that is driven mechanically by a crankshaft. Further still, the intake valves of firing cylinders may be opened by cam lobes of a camshaft, the camshaft mechanically driven by the crankshaft. In yet another example, the intake valves of skipped cylinders are held open for an entirety of intake and compression strokes, and at least a portion of a power stroke. The method may further comprise adjusting one or more of a firing pattern and a number of cylinders to be skipped while skip-firing the engine, based on a temperature of an exhaust after-treatment system. In another example, the method may further comprise adjusting one or more of a firing pattern and/or a number of cylinders to be skipped while skip-firing the engine, based on one or more of engine speed, fuel demand, exhaust gas temperature, and/or exhaust gas oxygen concentration. In yet another example, the method may further comprise adjusting one or more of a firing pattern and/or a number of cylinders to be skipped while skip-firing the engine, based on power output stability.

In another embodiment, a method for controlling an engine includes, with a controller (e.g., having one or more processors), skip-firing the engine when fueling demands are less than a threshold, such that when the engine is skip-fired, one or more cylinders of the engine are fired (firing cylinders) and one or more other cylinders of the engine are not fired (skipped cylinders), across plural combustion cycles of the engine. For example, there may be a skip-firing mode of operation as indicated, which is initiated based on the fueling demand threshold, and another, different mode of operation where all cylinders of the engine are fired in a given combustion cycle. The method further includes, with the controller, holding open intake valves of the skipped cylinders for a greater duration than intake valves of the firing cylinders. For example, the greater duration may be relative to one or more combustion cycles when the engine is operated in the skip-firing mode, such that: in the time period of one combustion cycle when the engine is operated in the skip-firing mode, the intake valves of the skipped cylinders are held open for a longer time than the intake valves of the firing cylinders; and/or in the time period of plural consecutive combustion cycles when the engine is operated in the skip-firing mode, the intake valves of the skipped cylinders are held open for a longer time than the intake valves of the firing cylinders.

As another example, a method for an engine comprises: determining when to initiate skip-fire mode based on engine operating conditions including one or more of engine speed, commanded fuel injection amount, engine load, fuel rail pressure, and/or commanded injector PWM pulse-width; initiating the skip-fire mode in response to the engine operating conditions decreasing below a threshold; and closing intake valves of non-firing cylinders during power or exhaust strokes of the non-firing cylinders. The method may further comprise adjusting the threshold based on one or more of cylinder-to-cylinder variance and/or injection-to-injection variance, where the variances are determined based on measured torque contributions from each firing cylinder via a crankshaft speed sensor, and where the threshold increases for increases in one or more of the variances. In another example, the method may further comprise determining a number of cylinders to skip during the skip-fire mode based on one or more of engine speed, fuel demand, exhaust gas temperature, and/or exhaust gas oxygen concentration. The method may further comprise determining which cylinders to skip based on the number of cylinders to be skipped and a pre-set pattern for controlling engine vibration and speed stability. Additionally, the method may further comprise determining a firing frequency for each firing cylinder over an upcoming threshold number of engine cycles based on the number of cylinders to be skipped during each engine cycle and a desired firing pattern for each engine cycle. In another example, the skip-fire mode is initiated in response to one or more of: the engine speed crossing a speed threshold, the commanded fuel injection amount decreasing below a fueling threshold, the engine load decreasing below a load threshold, engine idling, braking, and/or dynamic braking. In one example, initiating the skip-fire mode in response to the engine operating conditions decreasing below the threshold includes initiating the skip-fire mode in response to one or more of: the engine speed crossing a speed threshold, the commanded fuel injection amount decreasing below a fueling threshold, and/or the engine load decreasing below a load threshold. In another example, initiating the skip-fire mode in response to a determination that one or more fuel injectors or cylinders of the engine is degraded and, in response to initiating the skip-fire mode in response the determination that one or more fuel injectors or cylinders of the engine is degraded, calling for a service interruption to implement a corrective action to service the degraded fuel injector or cylinder.

In another embodiment, a method for controlling an engine includes, with a controller (e.g., having one or more processors), determining when to initiate a skip-fire mode based on engine operating conditions including one or more of engine speed, commanded fuel injection amount, engine load, fuel rail pressure, and/or fuel injector pulse-width. In the skip-fire mode, in a given combustion cycle (or across plural consecutive combustion cyclers), one or more cylinders of the engine are fired (firing cylinders) and one or more other, different cylinders of the engine are not fired (non-firing cylinders). The method further includes, with the controller, initiating the skip-fire mode in response to the engine operating conditions decreasing below a threshold, and while in the skip-fire mode, closing intake valves of the non-firing cylinders during power or exhaust strokes of the non-firing cylinders.

As yet another example, a system for an engine, comprises: a plurality of engine cylinders, each cylinder including: a first intake valve actuator mechanically driven by a crankshaft; and a second intake valve actuator not driven by the crankshaft. The system further comprises a controller with computer readable instructions stored in non-transitory memory for: not injecting fuel into all of the plurality of engine cylinders when fueling demands decrease below a threshold; adjusting intake valves of firing cylinders via the first intake valve actuator; and adjusting intake valves of non-firing cylinders via the second intake valve actuator. In one example of the system, the controller is electrically coupled to each second intake valve actuator for adjusting the position of the intake valves independently of the crankshaft by adjusting command signals sent to each second intake valve actuator. In another example of the system, the computer readable instructions further include instructions for maintaining the intake valves of non-firing cylinders open after the intake valves of firing cylinders are closed by the first intake valve actuator. In yet another example of the system, the computer readable instructions further include instructions for adjusting the closing timing of the intake valves of non-firing cylinders via the second intake valve actuator based on one or more of engine speed, fuel demand, exhaust gas temperature, and/or exhaust gas oxygen concentration.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an engine, comprising:

skip-firing the engine when fueling demands are less than a threshold; and holding open intake valves of skipped cylinders for a greater duration than intake valves of firing cylinders and for an entirety of intake and compression strokes, and at least a portion of a power stroke.

2. The method of claim 1, further comprising adjusting the threshold based on cylinder to cylinder torque imbalances, where the threshold is increased for increases in the cylinder to cylinder torque imbalances.

3. The method of claim 1, further comprising adjusting the threshold based on a fuel rail pressure, where the threshold increases for increases in fuel rail pressure.

4. The method of claim 1, further comprising adjusting the threshold based on a fuel injector pulse-width signal, where the threshold increases for decreases in the pulse-width single below a pre-defined, lower threshold pulse-width signal.

5. The method of claim 1, where the intake valves of the skipped cylinders are held open via actuators controlled by an engine controller and coupled to the intake valves, and where the actuators comprise one or more of electric, mechanical, pneumatic, hydraulic, or electromagnetic actuators.

6. The method of claim 5, where the actuators adjust the position of the intake valves independently of a cam timing system that is driven mechanically by a crankshaft and where the intake valves of firing cylinders are opened by cam lobes of a camshaft, the camshaft mechanically driven by the crankshaft.

7. The method of claim 1, further comprising adjusting one or more of a firing pattern or a number of cylinders to be skipped while skip-firing the engine, based on a temperature of an exhaust after-treatment system.

8. The method of claim 1, further comprising adjusting one or more of a firing pattern or a number of cylinders to be skipped while skip-firing the engine, based on one or more of engine speed, fuel demand, exhaust gas temperature, or exhaust gas oxygen concentration.

9. The method of claim 1, further comprising adjusting one or more of a firing pattern or a number of cylinders to be skipped while skip-firing the engine, based on one or more of power output stability or engine speed stability.

10. A method for an engine, comprising:

determining when to initiate a skip-fire mode based on engine operating conditions including one or more of engine speed, commanded fuel injection amount, engine load, fuel rail pressure, or fuel injector pulse-width;

initiating the skip-fire mode in response to the engine operating conditions decreasing below a threshold;

closing intake valves of non-firing cylinders during power or exhaust strokes of the non-firing cylinders; and determining a number of cylinders to skip during the skip-fire mode based on one or more of engine speed, fuel demand, exhaust gas temperature, or exhaust gas oxygen concentration, and further comprising determining which cylinders to skip based on the number of cylinders to be skipped and a pre-set pattern for controlling engine vibration, power, and speed stability.

11. The method of claim 10, further comprising adjusting the threshold based on one or more of cylinder-to-cylinder variance or injection-to-injection variance, where the variances are determined based on measured torque contributions from each firing cylinder via a crankshaft speed sensor, and where the threshold increases for increases in one or more of the variances.

12. A method for an engine, comprising:

determining when to initiate a skip-fire mode based on engine operating conditions including one or more of engine speed, commanded fuel injection amount, engine load, fuel rail pressure, or fuel injector pulse-width;

initiating the skip-fire mode in response to the engine operating conditions decreasing below a threshold;

closing intake valves of non-firing cylinders during power or exhaust strokes of the non-firing cylinders;

determining a number of cylinders to skip during the skip-fire mode based on one or more of engine speed, fuel demand, exhaust gas temperature, or exhaust gas oxygen concentration, and further comprising determining which cylinders to skip based on the number of cylinders to be skipped and a pre-set pattern for controlling engine vibration, power, and speed stability; and determining a firing frequency for each firing cylinder over an upcoming threshold number of engine cycles based on the number of cylinders to be skipped during each engine cycle and a desired firing pattern for each engine cycle.

13. The method of claim 10, wherein the skip-fire mode is initiated in response to one or more of: the engine speed crossing a speed threshold, the commanded fuel injection amount decreasing below a fueling threshold, the engine load decreasing below a load threshold, engine idling, braking, or dynamic braking.

14. The method of claim 10, wherein initiating the skip-fire mode in response to the engine operating conditions decreasing below the threshold includes initiating the skip-fire mode in response to one or more of: the engine speed crossing a speed threshold, the commanded fuel injection amount decreasing below a fueling threshold, or the engine load decreasing below a load threshold.

15. A method for an engine, comprising:

determining when to initiate a skip-fire mode based on engine operating conditions including one or more of engine speed, commanded fuel injection amount, engine load, fuel rail pressure, or fuel injector pulse-width;

initiating the skip-fire mode in response to the engine operating conditions decreasing below a threshold;

closing intake valves of non-firing cylinders during power or exhaust strokes of the non-firing cylinders; and initiating the skip-fire mode in response to a determination that one or more fuel injectors or cylinders of the engine is degraded and, in response to initiating the skip-fire mode in response to the determination that one or more fuel injectors or cylinders of the engine is degraded, calling for a service interruption to implement a corrective action to service the degraded fuel injector or cylinder.

16. A system for an engine, comprising:

a plurality of engine cylinders, each cylinder including:

a first intake valve actuator mechanically driven by a crankshaft; and a second intake valve actuator not driven by the crankshaft; and a controller with computer readable instructions stored in non-transitory memory for:

not injecting fuel into all of the plurality of engine cylinders when fueling demands decrease below a threshold;

adjusting intake valves of firing cylinders via the first intake valve actuator;

adjusting intake valves of non-firing cylinders via the second intake valve actuator; and wherein the controller is electrically coupled to each second intake valve actuator for adjusting the position of the intake valves independently of the crankshaft by adjusting command signals sent to each second intake valve actuator and wherein the computer readable instructions further include instructions for maintaining the intake valves of non-firing cylinders open after the intake valves of firing cylinders are closed by the first intake valve actuator.

17. The system of claim 16, wherein the computer readable instructions further include instructions for adjusting the closing timing of the intake valves of non-firing cylinders via the second intake valve actuator based on one or more of engine speed, fuel demand, exhaust gas temperature, or exhaust gas oxygen concentration.

* * * * *